US010786075B1

(12) United States Patent
Ghiorghie et al.

(10) Patent No.: US 10,786,075 B1
(45) Date of Patent: Sep. 29, 2020

(54) MODULAR STORAGE SYSTEM WITH FOLDABLE STORAGE CONTAINERS

(71) Applicant: InterDesign, Inc., Solon, OH (US)

(72) Inventors: Radu Alexandru Ghiorghie, Copley, OH (US); Patrick Brown, Cleveland Heights, OH (US); Joshua Eliezer Levine, Beachwood, OH (US)

(73) Assignee: InterDesign, Inc., Solon, OH (US)

( * ) Notice: Subject to any disclaimer, the term of this patent is extended or adjusted under 35 U.S.C. 154(b) by 0 days.

(21) Appl. No.: 16/112,078

(22) Filed: Aug. 24, 2018

Related U.S. Application Data

(60) Provisional application No. 62/549,718, filed on Aug. 24, 2017.

(51) Int. Cl.

| | |
|---|---|
| ***A47B 61/00*** | (2006.01) |
| ***A47B 47/00*** | (2006.01) |
| ***A47B 43/04*** | (2006.01) |
| ***A47B 67/04*** | (2006.01) |
| ***A47B 96/02*** | (2006.01) |
| ***A47B 88/969*** | (2017.01) |
| *A47F 5/13* | (2006.01) |

(52) U.S. Cl.
CPC ..... *A47B 43/04* (2013.01); *A47B 67/04* (2013.01); *A47B 88/969* (2017.01); *A47B 96/024* (2013.01); *A47B 2210/01* (2013.01); *A47F 5/13* (2013.01)

(58) Field of Classification Search
CPC ..... A47B 43/04; A47B 88/969; A47B 67/04; A47B 61/00; A47B 61/005
See application file for complete search history.

(56) References Cited

U.S. PATENT DOCUMENTS 589,463 A * 9/1897 Case ..... E05D 3/022 312/326
3,538,842 A * 11/1970 Labbato ..... A47B 61/00 108/29
3,563,182 A * 2/1971 MacFarlane ..... A47B 61/003 108/29
3,865,336 A * 2/1975 Robertson ..... A47B 61/00 108/29

(Continued)

OTHER PUBLICATIONS

Third-party dresser purchased after Aug. 24, 2017 and before Aug. 24, 2018.

*Primary Examiner* — Kimberley S Wright
(74) *Attorney, Agent, or Firm* — Calfee Halter & Griswold LLP

(57) ABSTRACT

A modular storage system having a frame system, a rod attachment system, and one or more shelves or storage containers. The rod attachment system comprises a rod, a connector, and a fastener. The connector may be secured around a support rod of the frame system and the fastener may extend through the connector and secure the rod to the frame system. The rod may also be secured in a wall mount. The frame system may have a plurality of shelf openings and the shelves or storage containers may be interchangeably disposed in the shelf openings. The storage containers may have an end wall which is substantially the height of the shelf opening and an end wall which is less than the height of the shelf opening. The storage container may be disposed in the shelf opening with either end wall facing out of the shelf opening.

13 Claims, 35 Drawing Sheets

(56) References Cited

U.S. PATENT DOCUMENTS 4,206,955 A * 6/1980 Cooper ..... A47B 61/00 108/61
4,209,099 A * 6/1980 Wickes ..... A47B 61/003 211/105.3
4,488,651 A * 12/1984 Bishop ..... A47K 3/38 211/105.6
4,928,833 A * 5/1990 Huizenga ..... A47B 95/008 108/152
5,469,999 A * 11/1995 Phirippidis ..... B60R 5/04 220/23.4
5,582,306 A * 12/1996 Balter ..... A47B 61/00 211/105.1
5,865,517 A * 2/1999 Wang ..... A47B 45/00 211/175
D409,866 S * 5/1999 West ..... D6/705.1
5,899,346 A * 5/1999 Newkirk ..... A47B 43/00 108/176
6,079,803 A * 6/2000 West ..... A47B 45/00 211/186
6,082,560 A * 7/2000 Timm ..... A47B 57/10 108/152
6,896,341 B2 * 5/2005 Cattoire ..... A47B 61/00 312/205
7,384,107 B2 * 6/2008 Humberto ..... A47B 57/10 108/193
7,562,951 B2 * 7/2009 Tallman ..... A47B 87/0207 211/86.01
7,673,762 B2 * 3/2010 Humberto ..... A47B 61/00 211/186
7,789,365 B2 * 9/2010 Durig ..... F16B 2/02 248/215
8,132,768 B2 * 3/2012 Fernandez ..... A47B 96/06 248/254
8,448,794 B1 * 5/2013 Wang ..... A47B 61/00 206/286
9,498,058 B2 * 11/2016 Espinosa ..... A47B 61/003
9,661,920 B2 * 5/2017 Ahart ..... A47B 47/0091
9,743,762 B1 * 8/2017 Beuses ..... A47B 61/003
10,021,974 B2 * 7/2018 Beuses ..... A47G 25/0692
10,021,975 B1 * 7/2018 Womble ..... A47B 96/021
2003/0090178 A1 * 5/2003 Cattoire ..... A47B 45/00 312/205
2004/0256337 A1 * 12/2004 Humberto ..... A47B 61/00 211/87.01
2004/0263030 A1 * 12/2004 Humberto ..... A47B 57/10 312/245
2005/0029911 A1 * 2/2005 Sheng-Bin ..... A47B 43/04 312/258
2008/0135509 A1 * 6/2008 Jackson ..... A47B 57/54 211/123
2009/0050590 A1 * 2/2009 Lutgen ..... A47B 47/0083 211/134
2011/0018405 A1 * 1/2011 Esquenazi ..... A47B 61/00 312/109
2012/0299454 A1 * 11/2012 Sabounjian ..... A47B 43/04 312/258
2016/0007742 A1 * 1/2016 Yang ..... A47B 61/00 211/123
2016/0198849 A1 * 7/2016 Espinosa ..... A47B 61/003 108/29
2016/0235195 A1 * 8/2016 Ahart ..... A47B 47/0091

* cited by examiner

MODULAR STORAGE SYSTEM WITH FOLDABLE STORAGE CONTAINERS

CROSS-REFERENCE TO RELATED APPLICATIONS

This application claims priority to and the benefit of U.S. Provisional Patent Application Ser. No. 62/549,718, filed Aug. 24, 2017 and entitled "Modular Closet Systems and Methods," the entire disclosure of which is incorporated herein by reference in its entirety.

BACKGROUND

Applicant has realized that there is a need for better storage systems. More particularly, Applicant realized that there is a need for better modular storage systems for use in closets or to create closet-like storage for the storage of items such as clothes, hangars, jewelry, and shoes.

SUMMARY

Storage systems herein contain a frame system, one or more rod attachment systems, and one or more storage containers or shelves. The storage systems may be assembled and re-assembled by a user at a desired location.

An exemplary storage container comprises: a flexible bottom having a first edge, a second edge, a third edge, and a forth edge; a first end extending from the first edge of the bottom to a first height substantially the same as a height of a shelf opening of the storage system; a second end extending from the third edge of the bottom to a second height less than the height of the shelf opening; a first side wall extending from the second edge of the bottom to a point substantially equivalent to the first height near the first end and the second height near the second end; a second side wall extending from the fourth edge of the bottom to a point substantially equivalent to the first height near the first end and the second height near the second end; and a rigid insert receivable between the first and second ends and first and second side walls; wherein the first and second side walls are inwardly collapsible when the rigid insert is removed from the storage container; and wherein the storage container may be inserted into the shelf opening with either the first or second end facing outward from the storage system.

An exemplary rod attachment system comprises: a rod having a first end and a second end, the second end having a receiving portion a fastener having a cap portion with a first diameter and a projection portion with a second diameter, the first diameter being larger than the second diameter; and a connector having a planar portion and an arcuate portion, the planar portion having a first side, a second side opposite the first side, and an aperture extending from the first side to the second side and having a third diameter; wherein the third diameter is larger than the second diameter and smaller than the first diameter; and wherein the rod attachment system is securable to the storage system by disposing the arcuate portion over a support rod of the storage system, inserting the projection portion of the connector through the aperture from the first side to the second side, and securing the projection portion of the connector in the receiving portion of the rod.

An exemplary storage system comprises: a frame system comprising: a first side frame comprising a first leg, a second leg, a support rod connecting the first leg and second leg, and at least one shelving track extending horizontally between the first and second legs; a second side frame comprising a third leg, a fourth leg, a support rod connecting the third and fourth legs, and at least one shelving track extending horizontally between the third and fourth legs; and at least one connector bar connecting the first side frame and the second side frame; a rod attachment system comprising; a rod having a first end, a second end, and a receiving portion in the second end; a connector having an arcuate portion, a planar portion, and an aperture through the planar portion; and a fastener having a cap portion and a projection portion, the projection portion being securable within the receiving portion of the rod; and a mount having a rod receiving portion and being securable to a wall.

BRIEF DESCRIPTION OF DRAWINGS

Further features and advantages of the invention will become apparent from the description of embodiments using the accompanying drawings. In the drawings.

DETAILED DESCRIPTION

This Detailed Description merely describes exemplary embodiments of the invention and is not intended to limit the scope of the claims in any way. Indeed, the invention as claimed is broader than and unlimited by the preferred embodiments, and the terms used in the claims have their full ordinary meaning.

Figure 1:
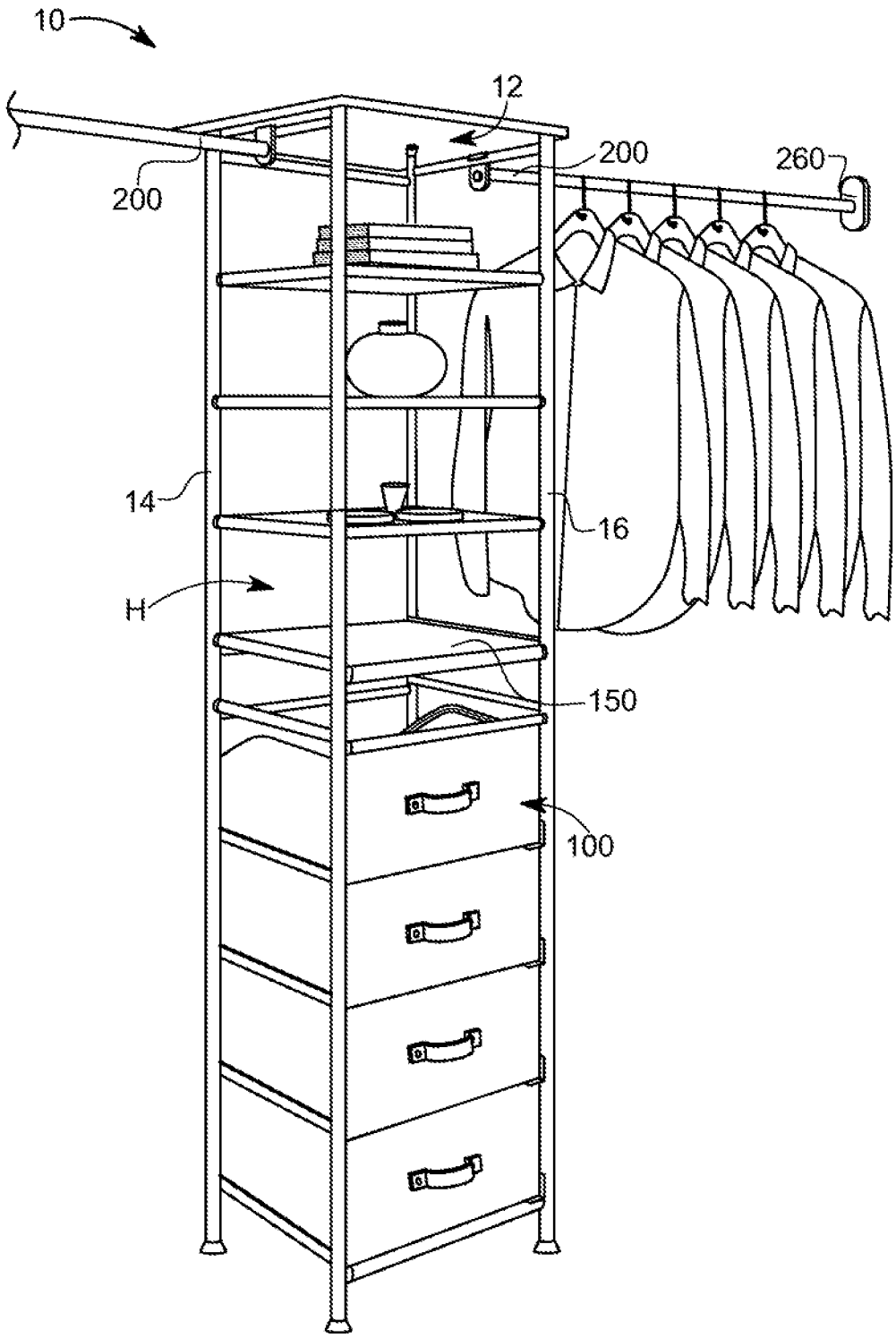
FIG. 1 is a perspective view of an exemplary storage system.

Referring to FIG. 1, an exemplary storage system 10 is shown. The storage system 10 includes a frame system 12, one or more rod attachment systems 200, and one or more mounts 260. In a preferred embodiment, the storage system 10 is modular in that the storage system 10 may be packaged, stored, and transported in a relatively small and flat package and subsequently assembled or re-assembled by a user at a desired location, such as a bedroom, closet, or other similar location. Additionally, the storage system 10 is customizable in that it may take various configurations, shapes, and designs, as detailed below.

Turning to FIGS. 2-6, an exemplary frame system 12 is shown. The frame system 12 includes one or more first side frames 14, one or more second side frames 16, and one or more connector bars 18. The frame system 12, when assembled, may provide a self-standing modular storage system for use with items to be stored in a closet such as hung and/or folded clothing, shoes, jewelry, and the like. The frame system 12 may be customized to different heights or by including various drawers, bins, storage containers, and/or shelving units, The first and second side frames 14,16 each include a first leg 20, a second leg 22, a horizontal support rod 40, and one or more shelving tracks 50. The first and second legs 20, 22 are generally cylindrical tubes which extend in the vertical direction and each have an outer circumferential leg surface 24, an upper end 26, an upper portion 28 near the upper end 26, a lower end 30, a lower portion 32 near the lower end 30, and at least one lateral aperture 36. The first and second legs 20, 22 may be substantially hollow or may have hollowed portions near the upper and/or lower portions 28, 32 extending inwardly from the upper and lower ends 26, 30 and defining a circumferential inner leg surface 34. The first and second legs 20, 22 may include lateral apertures 36 in the upper and lower portions 28, 32 which are aligned along the length of the first and second legs 20, 22. The lateral apertures 36 may extend through the first and second legs 20, 22.

The outer circumferential leg surface 24 and circumferential inner leg surface 34 of the first and second legs 20, 22 may be sized and shaped such that the lower portion 32 of one first or second leg 20, 22 may fit on top of and/or around the outer circumferential leg surface 24 of the upper portion 28 of another first or second leg 20, 22. For example, the outer circumferential leg surface 24 of the first and second legs 20, 22 may be inwardly tapered or otherwise reduced in diameter near the upper portion 28 close to the upper end 26, the first and second legs 20, 22 may include one or more projections 38 extending vertically from the upper end 26 having a diameter which is receivable in the lower portion 32 of the first or second leg 20, 22, and/or the outer circumferential leg surface 24 and circumferential inner leg surface 34 of the first and second legs 20, 22 may be outwardly flared or otherwise expanded near the lower portion 32 close to the lower end 30.

As shown in FIGS. 2-5, the support rod 40 is a substantially cylindrical rod having a front end 42, a rear end 44, and an outer circumferential rod surface 46. The support rod 40 extends horizontally between the first and second legs 20, 22 and connects the upper portions 26 of the first and second legs 20, 22. In one embodiment, the one or more support rods 40 are pre-attached to the first and second legs 20, 22 to form a single frame side 14, 16. For example, the each support rod 40 may be welded, glued, bolted, or fastened between the first and second legs 20, 22. However, in other embodiments, the one or more support rods 40 may be modular in that the support rod 40 may be separate from the first and second legs 20, 22 such that a user may attach the front end 42 of the support rod 40 to the first leg 20 and the rear end 44 of the support rod 40 to the second leg 22. For example, the front and rear ends 42, 44 of the support rod 40 may fasten, connect, or otherwise be secured in an aperture, receiving portion, lock, latch, or other suitable fastening mechanism to secure the support rod 40 between the first and second legs 20, 22.

When the first and second side frames 14, 16 are aligned in parallel, the lateral apertures 36 of the first and second legs 20, 22 of the first side frame 14 are respectively aligned with the lateral apertures 36 of the first and second legs 20, 22 of the second side frame 16. In a preferred embodiment, the lateral apertures 36 of the first legs 20 are in the same horizontal plane as the lateral apertures 36 of the second legs 22.

The first and second sides 14, 16 may be attached together by one or more connector bars 18 horizontally connecting the first leg 20 of the first side frame 14 to the first leg 20 of the second side frame 16 and one or more connector bars 18 connecting the second leg 22 of the first side frame 14 to the second leg 22 of the second side frame 16. Each connector bar 18 may have a first end 21, a second end 23, and an outer circumferential bar surface 25 extending between the first end 21 and the second end 23. In one embodiment, the connector bar 18 has threaded bores 27 extending inwardly from the first and second ends 21, 23. The threaded bores 27 may be sized, shaped, and threaded to threadingly receive a screw or other suitable fastener.

In one embodiment, the connector bars 18 are separate from the first and second side frames 14, 16 and may be connected, fastened, or otherwise secured to the first and second side frames 14, 16 by a user. The connector bars 18 may be connected between the first and second side frames 14, 16 by any suitable means. For example, the connectors 18 may be connected to the first and second side frame 14, 16 by extending a screw, nail, bolt, or other suitable fastener through the lateral apertures 36 of the first and second legs 20, 22 and into the threaded bores 27 of the connector bar 18. Further, the frame system 12 may also include one or more spacers 48 disposed between the first and second legs 20, 22 and connector bars 18. The spacers 48 may be substantially cylindrical with a flat end which abuts the first or second end 21, 23 of the connector bar 18 and a curved or rounded end which abuts the outer circumferential leg surface 24 of the first or second leg 20, 22. As the first and second legs 20, 22 have a round outer circumferential leg surface 24 and the ends of the connector bars 18 are generally flat, the spacers 48 provide a snug connection between the connector bars 18 and the first and second legs 20, 22. In other embodiments, the connectors 18 may be pre-attached to the first and second side frames 14, 16 such that the one or more connectors 18, the first side frame 14, and the second side 16 form a single shelving frame.

Figure 4:
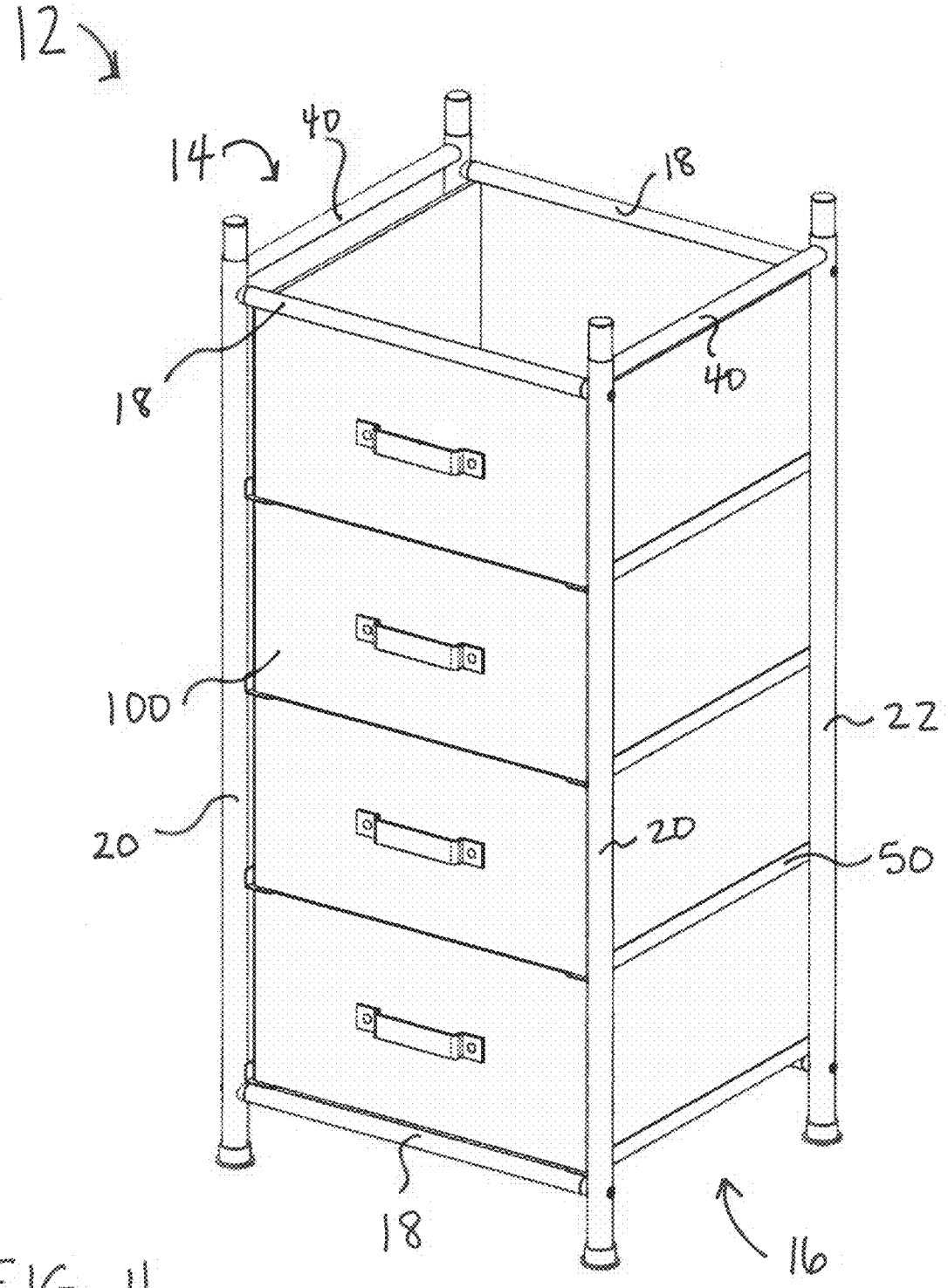
FIG. 4 is a front-top-right perspective view of the frame system of FIG. 3 with storage containers.
Figure 5:
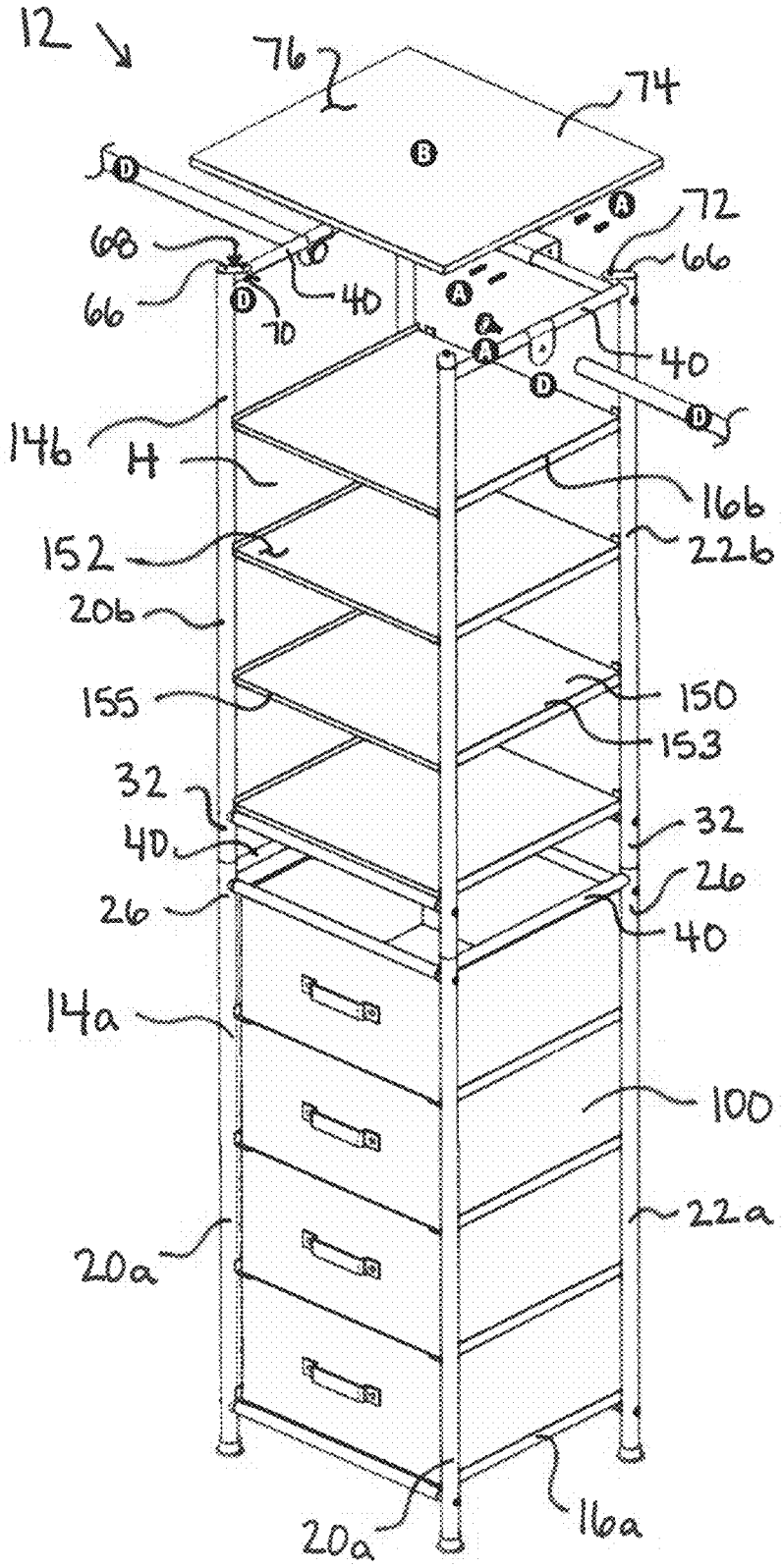
FIG. 5 is a front-top-right perspective view of an exemplary multi-tier frame system for use with the storage system.
Figure 6:
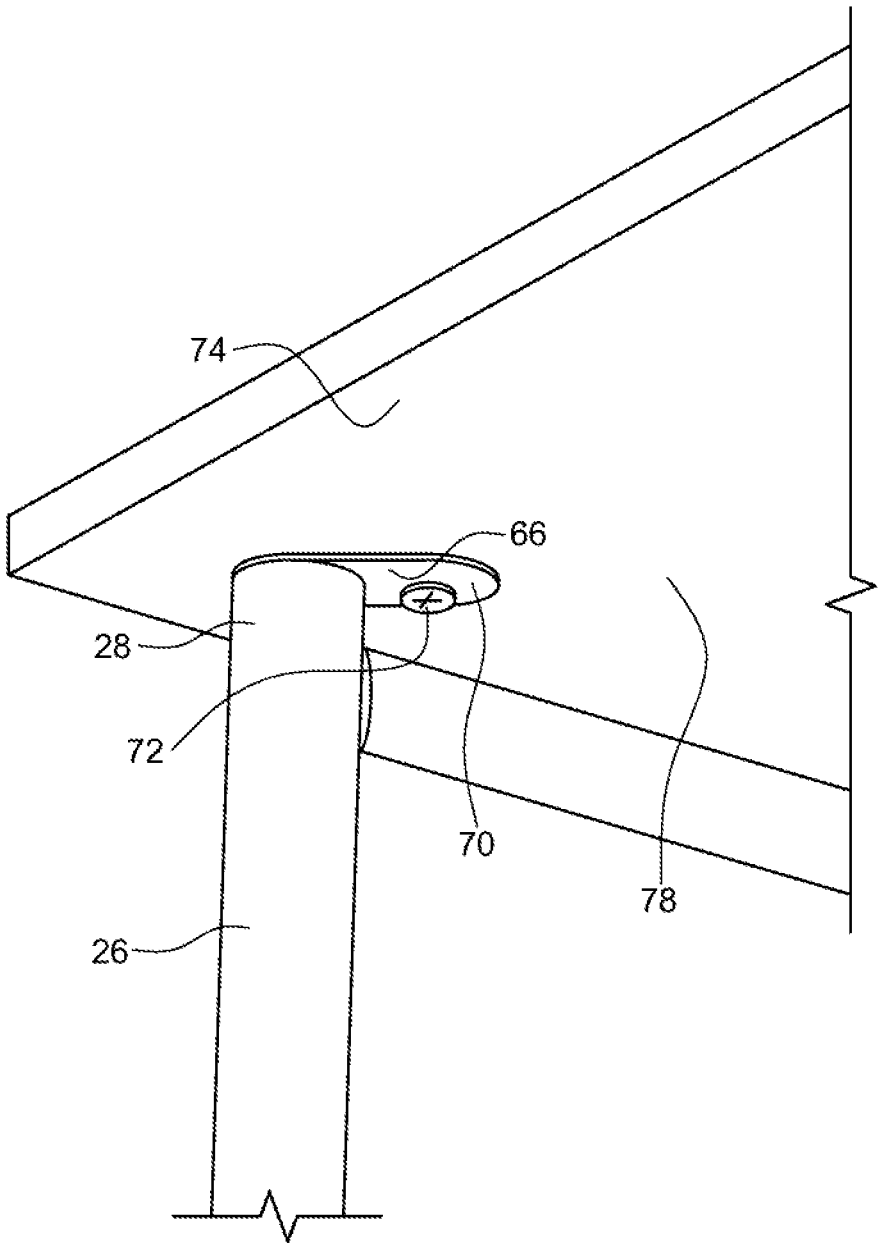
FIG. 6 is a bottom-front-right perspective view of an exemplary frame system with a top plate.

As shown in FIGS. 4 and 5, when the connector bars 18 connect the first and second side frames 14, 16, the resulting structure forms a substantially rectangular box frame. The first and second side frames 14, 16 each have a proximal side 17 facing the other side frame 14, 16 and a distal side 19 opposite the proximal side 17. The lateral apertures 36 extend from the distal side 19 to the proximal side 17 of the first and second legs 20, 22 of the first and second side frames 14, 16.

Figure 2:
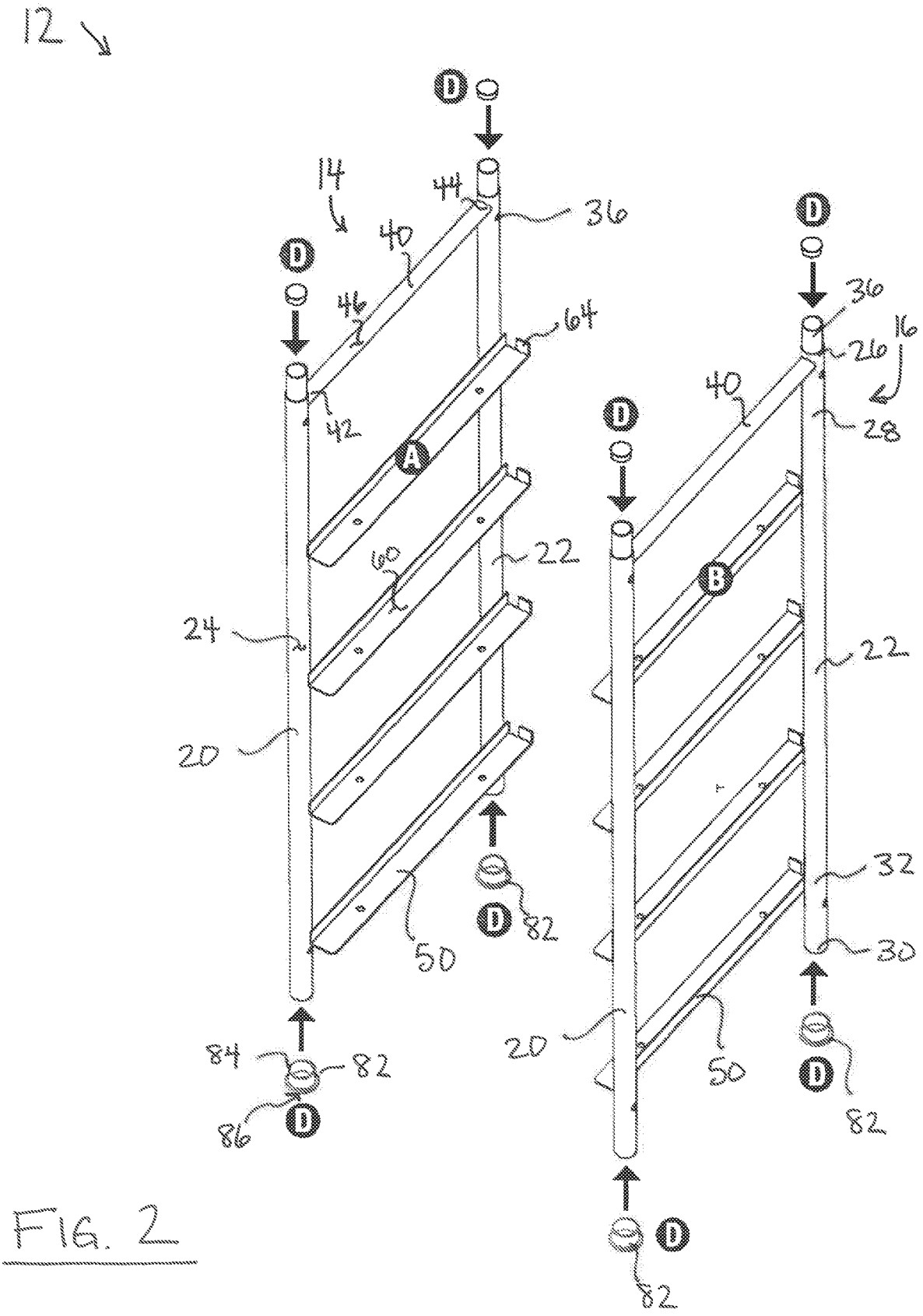
FIG. 2 is a front-top-right perspective view of an exploded partial exemplary frame system for use with the storage system.
Figure 3:
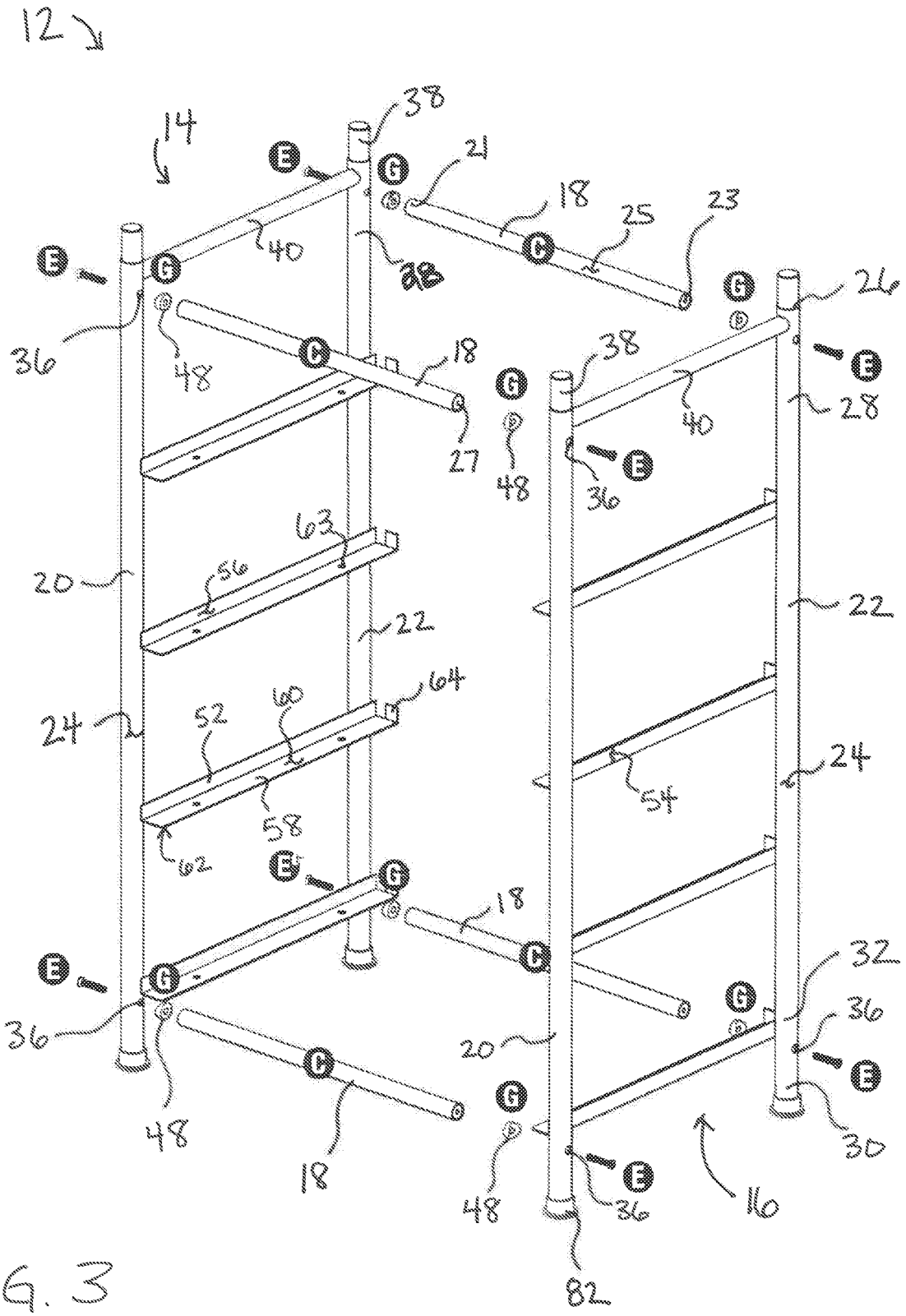
FIG. 3 is a front-top-right perspective view of an exploded exemplary frame system for use with the storage system.

Referring to FIGS. 2 and 3, the first and second side frames 14,16 may each include one or more shelving tracks 50 disposed horizontally on the proximal sides 17 of the first and second legs 20, 22 which provide structural support for the first and second side frames 14, 16 and may provide a shelving system, as detailed below. The shelving tracks 50 are generally L-shaped with a vertical wall 52 having an outside face 54 and an inside face 56 and a horizontal wall 58 having a top face 60 and a bottom face 62. The shelving tracks 50 may include a stop flange 64 at the rear of the shelving track 50 which projects upwardly from the horizontal wall 58. The shelving tracks 50 may be equally spaced along the height of the first and second side frames 14, 16. The shelving tracks 50 may be attached or otherwise secured to the first or second side frame 14, 16 such that the outside face 54 of the shelving tracks 50 abut or are connected with the proximal side 17 of the first and second legs 20, 22. The shelving tracks 50 may be welded, fastened to the first and second legs 20, 22 by screws, bolts, nails, or other suitable fasteners, or may be secured to the first and second legs 20, 22 by any other suitable securement means. In a preferred embodiment, the horizontal walls 58 of the shelving tracks 50 extend proximally inward from the vertical walls 52 to a distance sufficient to support a shelf or a storage container supporting or filled with items such as clothing, jewelry, shoes, or the like.

The shelving tracks 50 may further include one or more shelf apertures 63 in the horizontal wall 58 extending from bottom face 62 to the top face 60. The shelf apertures 63 may be inset from the front and rear ends of the shelving track 50 and disposed along the length of the shelving track 50. The shelf apertures 63 may be sized to receive a screw, bolt, nail, or other fastener.

When the first and second side frames 14, 16 are connected, as detailed below, the space between the inside face 56 of the vertical wall 52 of a shelving track 50 secured to the first side frame 14 and the inside face 56 of the vertical wall 52 of a correspondingly positioned shelving track 50 secured to the second side frame 16 defines a width of a shelf opening H. The space between the top face 60 of those two shelving tracks 50 and the bottom faces 62 of two shelving tracks 50 positioned successively above the two shelving tracks 50, or, for the top-most shelving tracks 50 of the side frame 14, 16, the connector bar 18 connecting the side frames 14, 16 above the top-most shelving tracks 50, defines a height of the shelf opening H. The shelf opening H has a depth which extends substantially the depth of the shelving tracks 50 and/or the first and second side frames 14, 16. The connector bars 18 connecting the lower portions 32 of the first legs 20 of the first and second side frames 14, 16 and the connector bars 18 connecting the lower portions 32 of the second legs 22 of the first and second side frames 14, 16 may be disposed below the bottom-most shelving tracks 50 such that the connector bars 18 do not disrupt the shelf opening H. The connector bars 18 connecting the upper portions 28 of the first legs 20 of the first and second side frames 14, 16 and the connector bars 18 connecting the upper portions 28 of the second legs 22 of the first and second side frames 14, 16 may be disposed a distance above the top-most shelving tracks 50 which is equal to the distance between the lower shelving tracks 50 such that the shelf opening H above the top-most shelving tracks 50 is substantially the same size as the other shelf openings H.

In the illustrated embodiment, the first and second side frame 14, 16 each have four shelving tracks 50. However, the first and second sides 14, 16 may have any number of shelving tracks 50. For example, the first and second sides 14, 16 may have one, two, three, or five or more shelving tracks 50 disposed between the first and second legs 20, 22.

In an optional embodiment, as shown in FIG. 5, the frame system 12 may include a lower pair of first and second sides frames 14*a*, 16*a* with lower first and second legs 20*a*, 22*a* and at least one upper pair of first and second sides frames 14*b*, 16*b* with upper first and second legs 20*b*, 22*b*. The upper pair of first and second side frames 14*b*, 16*b* may be stacked, placed, or otherwise disposed on the lower pair of first and second side frames 14*a*, 16*a*.

In one such embodiment, the lower portions 32 of the first and second legs 20*b*, 22*b* of the upper first and second side frames 14*b*, 16*b* may be placed on the upper end 26 of the first and second legs 20*a*, 22*a* of the lower first and second side frame 14*a*, 16*a* such that the upper ends 26 of the first and second legs 20*a*, 22*a* of the lower first and second side frames 14*a*, 16*a* may extend into the lower end 30 of the first and second legs 20*b*, 22*b* of the upper first and second side frame 14*b*, 16*b*. For example, the projections 38 of the first and second legs 20*a*, 22*a* of the lower first and second side frames 14*a*, 16*a* may extend into and be received within the circumferential inner leg surface 34 of the first and second legs 20*b*, 22*b* of the upper first and second side frame 14*b*, 16*b*. The projections 38 and circumferential inner leg surfaces 34 may be sized and shaped such that the projections 38 fit snugly within the circumferential inner leg surfaces 34. The lower first and second side frames 14*a*, 16*a* may support the upper first and second side frames 14*b*, 16*b* and the upper first and second side frames 14*a*, 16*a* may be secured in the lower first and second side frames 14*a*, 16*a* by the weight of the upper first and second side frames 14*b*, 16*b* and the force of gravity. However, the upper first and second side frames 14*b*, 16*b* may be secured or additionally secured in the lower first and second side frames 14*a*, 16*a* by additional means. For example, the lower portions 32 of the first and second legs 20*b*, 22*b* of the upper first and second side frames 14*b*, 16*b* may be secured in the upper portions 28 of the first and second legs 20*a*, 22*a* of the lower first and second side frames 14*a*, 16*a* by screws, bolts, nails, or other suitable fasteners, spring mechanisms, latches, magnets, or any other suitable means. The process may be repeated with additional pairs of first and second side frames 14, 16 on top of the upper first and second side frames 14*b*, 16*b*.

The first and second legs 20, 22 may also include a support flange 66 located at the upper portions 28 near the upper ends 26 and extending proximally inward and angled toward the opposite leg 22, 20 of the other side frame 14, 16. The support flange 66 may have a substantially flat upper surface 68, a lower surface 70 opposite the upper surface 68, and a plate aperture 72 in the upper surface 68 and extending through the support flange 66 to the lower surface 70. In the illustrated embodiment, the support flange 60 has a rounded edge. However, it will be understood that the support flange 66 may have any suitable shape which may support a top plate, as detailed below. For example, the support flange 66 may be rectangular, triangular, or any other suitable shape.

The frame system 12 may also include a rectangular top plate 74 having a top surface 76 and a bottom surface 78 which may be connected, attached, or otherwise secured to the upper portions 28 of the top-most first and second legs 20, 22 of the frame system 12. The top plate 74 may be a substantially flat plate or shelf having a with at least equivalent to the distance between the distal sides 19 of the first and second side frames 14, 16 and a depth at least equivalent to the distance between the upper ends 26 of the first and second legs 20, 22 of each of the first and second side frames 14, 16.

The top plate 74 may include bores 80 extending from the bottom surface 78 toward or to the top surface 76. The bores 80 may be disposed in the bottom surface 78 such that the bores 80 align with the plate apertures 72 of the first and second legs 20, 22 of the upper most first and second side frames 14, 16 when the frame system 12 is assembled. In one embodiment, the bores 80 are threaded. However, in other embodiments, the bores 80 may be unthreaded. The top plate 74 may be secured to the first and second side frame 14, 16 by inserting a screw, bolt, nail, or other suitable fastener through the support flanges 66 from the lower surface 70 to the upper surface 68 and into the bores 80 of the top plate 74.

The frame system 12 may further include one or more feet 82 attached to the bottom-most legs of the frame system 12, either the first and second legs 20, 22 of a single tiered frame system 12 or the first and second legs 20*a*, 22*a* of the lower first and second side frames 14*a*, 16*a* of a multi-tiered frame system 12. The feet 82 may have a ground contact face 84 which engages a floor or ground surface on which the frame system 12 is disposed and a connecting portion 86 which connects the feet 82 to one of the first or second leg 20, 22. The ground contact face 84 is substantially flat and has a surface area which is larger than the cross-sectional area of the first and second legs 20, 22. In the illustrated embodiment, the ground contact faces 84 are circular. However, the ground contact faces 84 may be any other suitable shape. For example, the ground contact faces 84 may be rectangular, triangular, oval, or any other suitable shape.

The connecting portion 86 of the feet 82 may connect or secure the feet to either the lower ends 30 or lower portions 32 of the first or second legs 20, 22. In the illustrated embodiment, the connecting portions 86 are hollow cylinders which extend upwardly from the ground surfaces 84. The cylinder is sized to snugly fit around the outer circumferential surface 24 of the lower portions 32 of the first or second legs 20, 22. In such embodiment, the feet 82 may be placed over the lower ends 30 of the first or second legs 20, 22 and the frame system 12 may then be place on a floor or ground surface. However, the feet 82 may be any other suitable design. For example, the connecting portions 86 of the feet 82 may be sized and shape to be secured in the lower ends 30 of the first or second legs 20, 22 by threads, spring loaded latches, securely fitting in the insider diameter 34 of the lower ends 30, magnets, or any other suitable securement methods.

When the feet 82 are secured to the first and second legs 20, 22 the ground contact faces 84 are substantially perpendicular to the length of the first and second legs 20, 22. As the ground contact faces 84 are substantially flat and have a diameter larger than the cross-sectional diameter of the first and second legs 20, 22, the feet 82 more evenly distribute the weight of the frame system 12 and thereby better stabilize the frame system 12 on the floor or other ground surface on which the frame system 12 is disposed. Additionally, the ground contact faces 84 of the feet 82 may be padded, coated or otherwise protect the floor or other surface on which the frame system 12 is disposed and prevent the frame system 12 from moving, shifting, slipping, or sliding on the floor or other surface.

Turning to FIGS. 4, 5, 8, 12A, 12B, and 13, the storage system 10 may include one or more drawers, bins, or storage containers 100 and/or one or more shelves 150. The storage containers 100 or shelves 150 may be inserted into the shelf openings H such that the storage containers 100 or shelves 150 may rest or otherwise be disposed on the top face 60 of the horizontal wall 58. The shelves 150 and storage containers 100 may have a horizontal depth substantially equivalent to the length of the shelving tracks 50 and a horizontal width substantially equivalent to the distance between the vertical walls 52 of the shelving frames 50 attached to the first and second side frames 14, 16. The storage containers 100 may have a height substantially equivalent to the vertical distance between the top face 60 of the horizontal wall 58 defining the bottom of the shelf opening H and the bottom face 62 of the horizontal wall 58 or connector bar 18 defining the top of the shelf opening H.

Referring to FIGS. 5, 7A, 7B, and 8-12B, a storage container 100 is depicted according to one embodiment. The storage container 100 is generally a rectangular box having an open top. The storage container 100 includes a rectangular base 102, a first end wall 108, a second end wall 110, a first side wall 112, and a second side wall 114. The base 102 has a first edge 102*a*, a second edge 102*b*, a third edge 102*c*, and a fourth edge 102*d*, and top surface 104 (not pictured), a bottom surface 106. The first end wall 108 extends upwardly from the first edge 102*a* of the base 102 to a first height 109. The second end wall 110 extends upwardly from the third edge 102*c* of the base 102 to a second height 111. The first side wall 112 extends upwardly from the second edge 102*b* of the base 102 to a first top edge 113 having a height substantially equivalent to the first height 109 near the first end wall 108 and a height substantially equivalent to the second height 111 near the second end wall 114. The second side wall 114 extends upwardly from the fourth edge 102*d* of the base 102 to a second top edge 115 having a height substantially equivalent to the first height 109 near the first end wall 108 and a height substantially equivalent to the second height 110 near the second end wall 110. The storage container 100 may be sized and shaped such that the storage container 100 may be disposed in the shelf opening H with either the first or second end wall 108, 110 facing outwardly from and defining a front of the shelf opening H.

In one embodiment, as shown in FIGS. 5, 7A, 7B, and 8, the storage container 100 is a substantially rectangular box and the first and second end walls 108, 110 and first and second side walls 112, 114 are rectangular. In such an embodiment, the first height 109 of the first end wall 108 and the second height 111 of the second end wall 110 are substantially the same. As the first and second heights 109, 111 are substantially similar, the first and second top edges 113, 115 are substantially linear and parallel to the base 102. The first and second heights 109, 111 may be substantially equivalent to the height of the shelf opening H such that the storage container 100 substantially fills the shelf opening H when the storage container 100 is disposed on the shelving tracks 50. The storage container 100 may additionally have a cover or lid which covers the interior of the storage container 100.

In a second embodiment, as shown in FIGS. 9A-12B, the first height 109 of the first end wall 108 is substantially the same as the height of the shelf opening H and the second height 111 of the second end wall 110 is less than the height of the shelf opening H. The first and second top edges 113, 115 may be curved, rounded, or otherwise shaped such that the height of the first and second side walls 112, 114 varies between a height substantially similar to the height of the shelf opening H or the first height 109 near the first end wall 108 and a height substantially similar to the second height 111 near the second end wall 110. In such an embodiment, when the storage container 100 is inserted in the shelf opening H of the frame system 12, there is a gap between the second end wall 110 and the shelving tracks 50 or connector bar 18 defining the top portion of the shelf opening H. The gap may be large enough for a user to see into the interior of the storage container 100 and/or remove items from the storage container 100 while the storage container 100 is disposed in the shelf opening H.

In the illustrated embodiment, the first and second end walls 108, 110 have a width of about 16.125 inches and the first and second side walls 112, 114 have a width of about 15.5 inches. the first height 109 of the first end wall 108 is about 8.125 inches and the second height 111 of the second end wall 110 is about 5.5 inches.

The first and second ends wall 108, 110 and the first and second side walls 112, 114 each have an interior face 116 which faces one of the other of the first and second end walls 108, 110 and the first and second side walls 112, 114 and an exterior face 118 opposite the interior face 116. The top surface 104 of the base 102 and the interior faces 116 of the first and second end walls 108, 110 and the first and second side walls 112, 114, when extending upwardly from the base 102 define an interior space J. When the first and second end walls 108, 110 and the first and second side walls 112, 114 extend upwardly from the base 102, clothing, jewelry, shoes, and other similar items may be placed in the in the interior space J of the storage container 100.

The first and second end walls 108, 110 and first and second side walls 112, 114 may be substantially rigid such that the first and second end walls 108, 110 and first and second side walls 112, 114 may stand upright in an erected position, as detailed below. The first and second end walls 108, 110 and first and second side walls 112, 114 may also be constructed from a material or in a manner that is relatively soft such that it is comfortable when a user touches it. For example, the first and second end walls 108, 110 and first and second side walls 112, 114 may be constructed of one or more inserts composed of cardboard, paperboard, cellulose, plastic, or other suitable material which is at least semi-rigid, encased in a fabric or cloth. The corners between the first and second end walls 108, 110 and first and second side walls 112, 114 may also be constructed such that the first and second end walls 108, 110 and first and second side walls 112, 114 may pivot, fold, or otherwise be moved at the respective corners, as detailed below. For example, the fabric casings of the first and second end walls 108, 110 and first and second side walls 112, 114 may be sewn or stitched together at the respective corners. In a further embodiment, the storage container 100 may include a binding along one or more of the first height 109 of the first end wall 108, the second height 111 of the second end wall 110, the first top edge 113 of the first side wall 112, and the second top edge 115 of the second side wall 114. The binding may be fabric, cloth, or other suitable material.

Figure 7A:
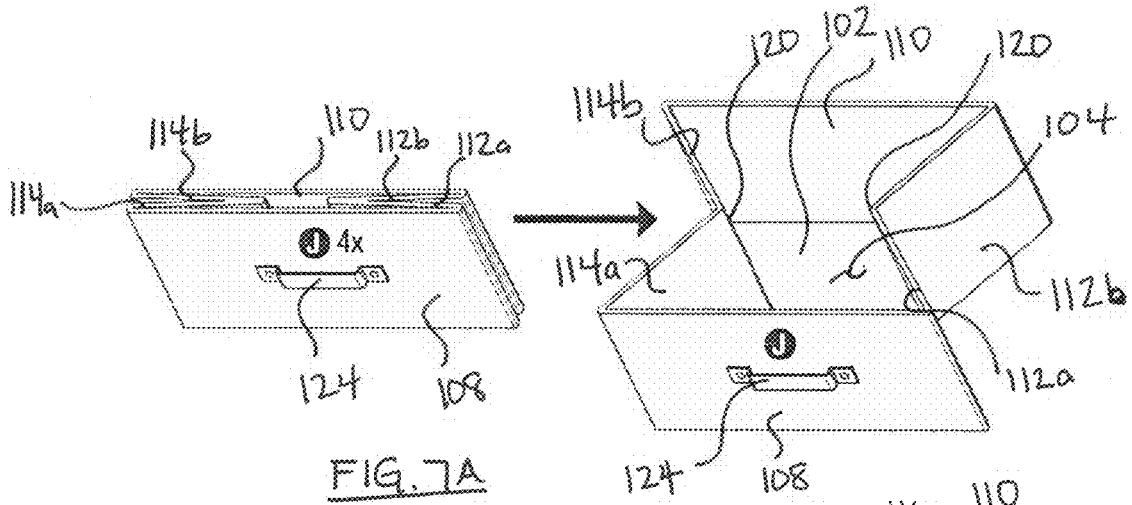
FIG. 7A is a front-top-right perspective view of a storage container according to one embodiment in a second or folded position.
Figure 11:
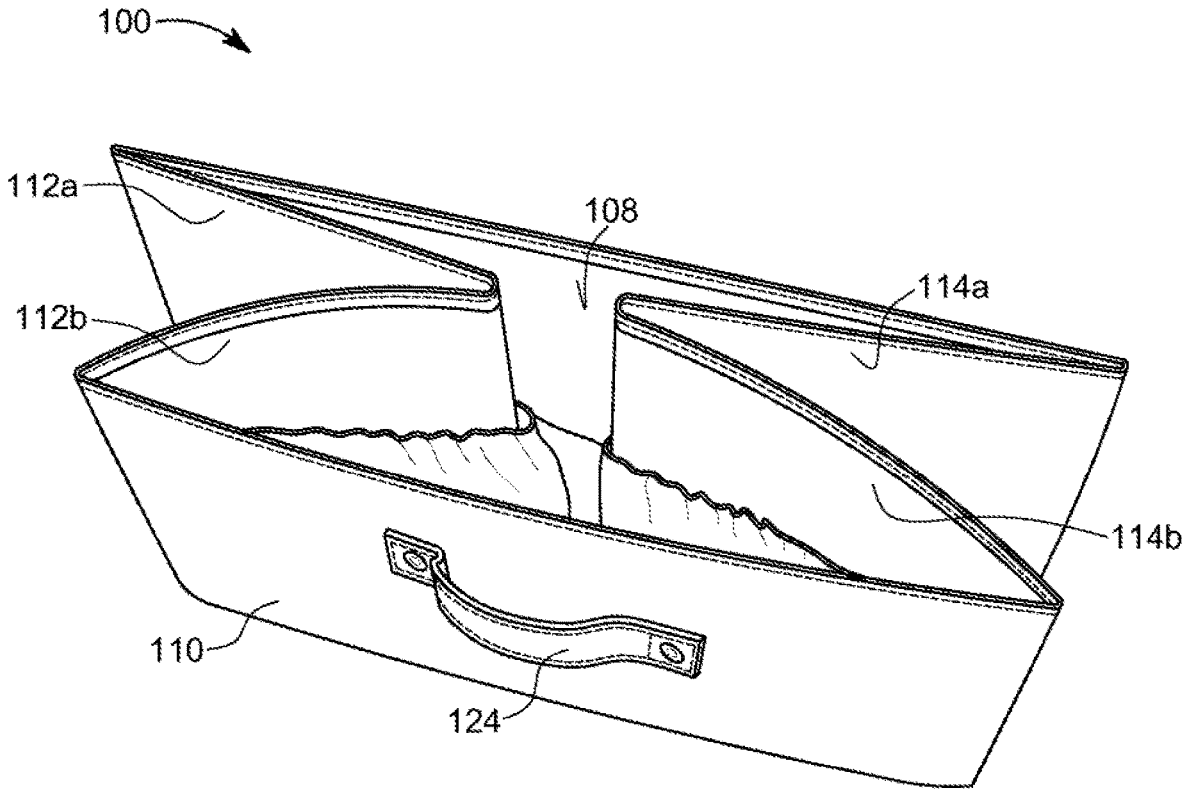
FIG. 11 is a trop-front-right perspective of the storage container of FIG. 9C in a folded position.
Figure 12A:
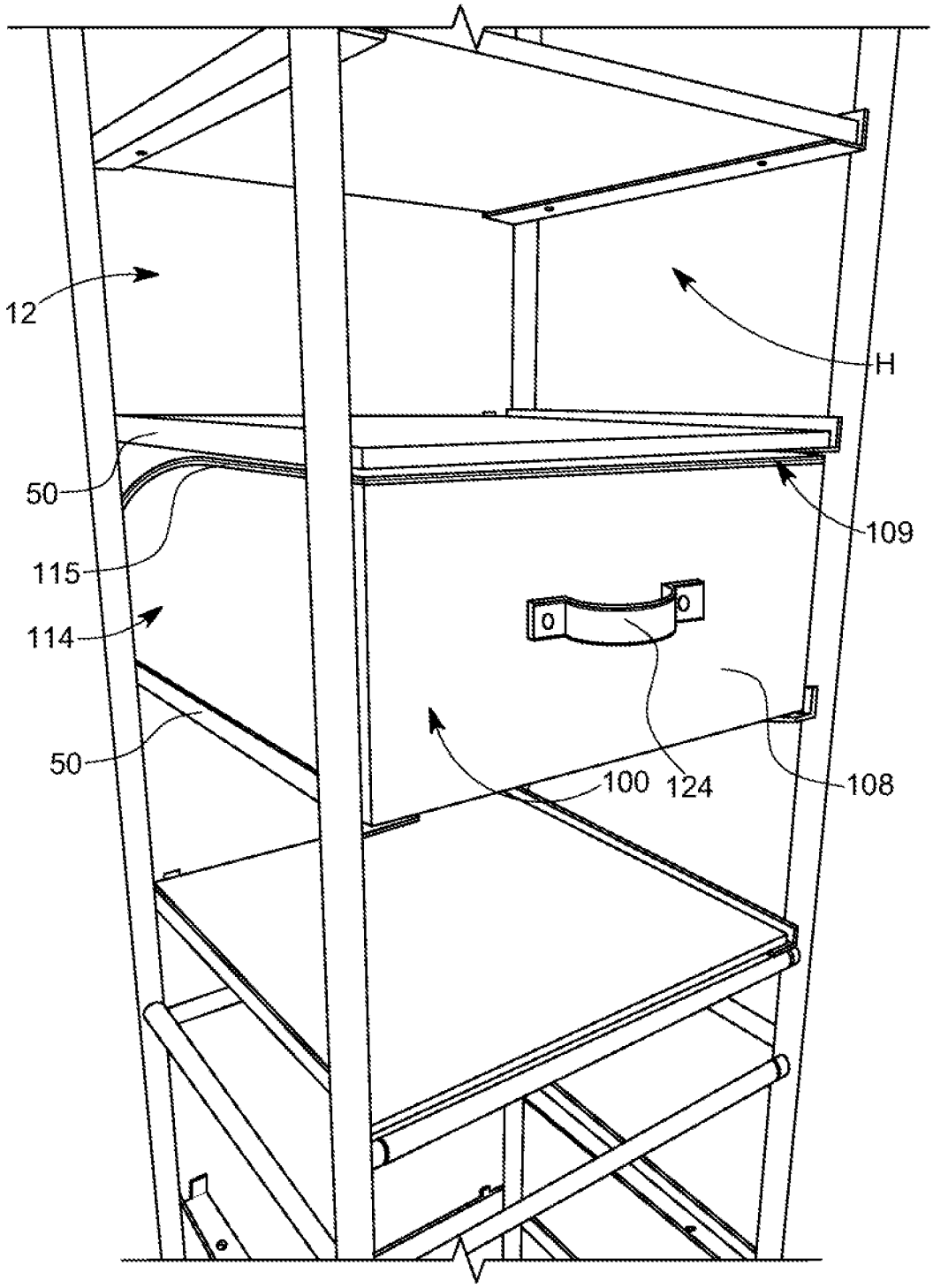
FIG. 12A is a front-left-top perspective view of the storage container of FIG. 9 disposed in a shelf opening of a frame system with the first end wall facing outwardly.
Figure 12B:
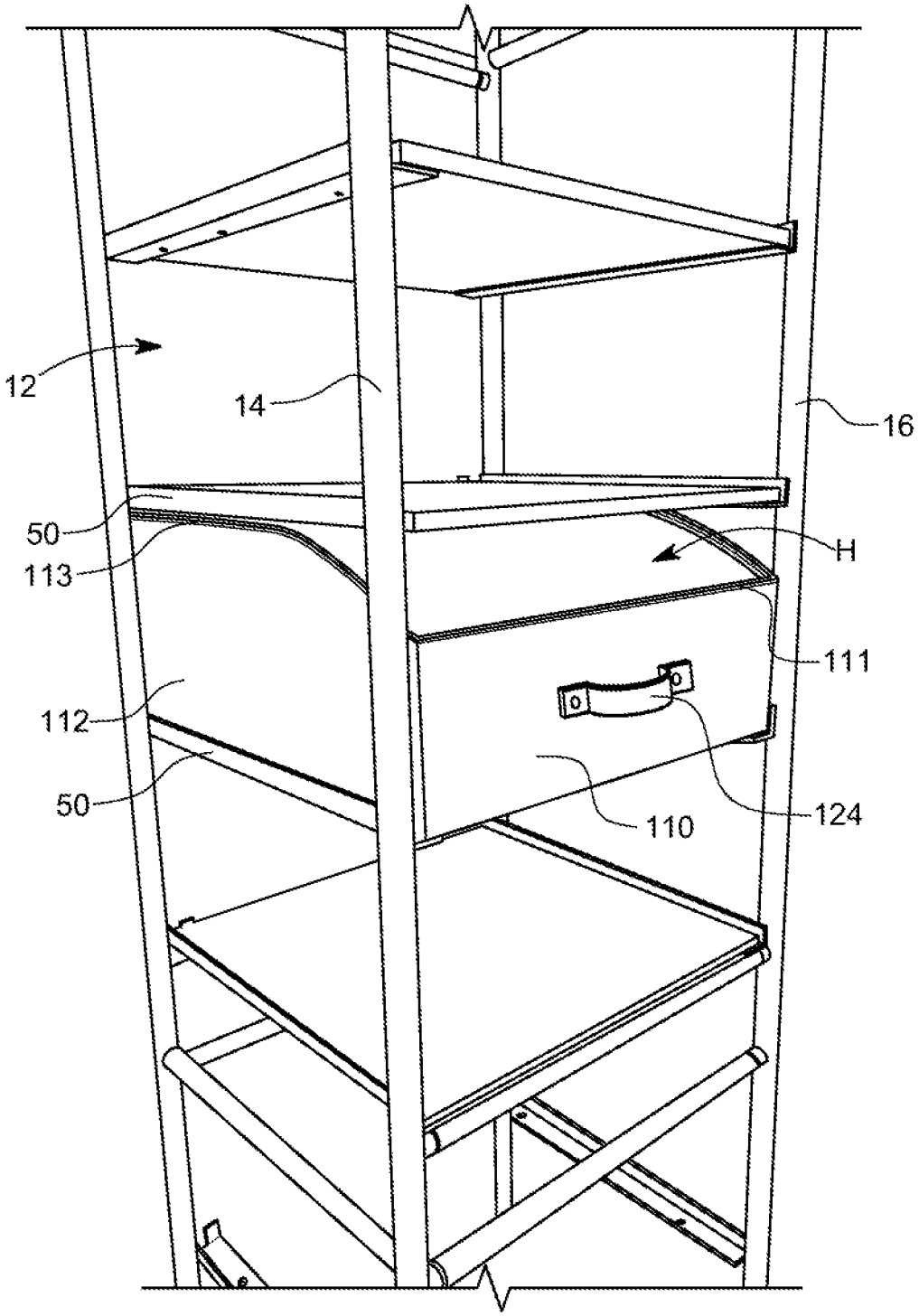
FIG. 12B is a front-left-top perspective view of the storage container of FIG. 9 disposed in a shelf opening of a frame system with the second end wall facing outwardly.
Figure 13:
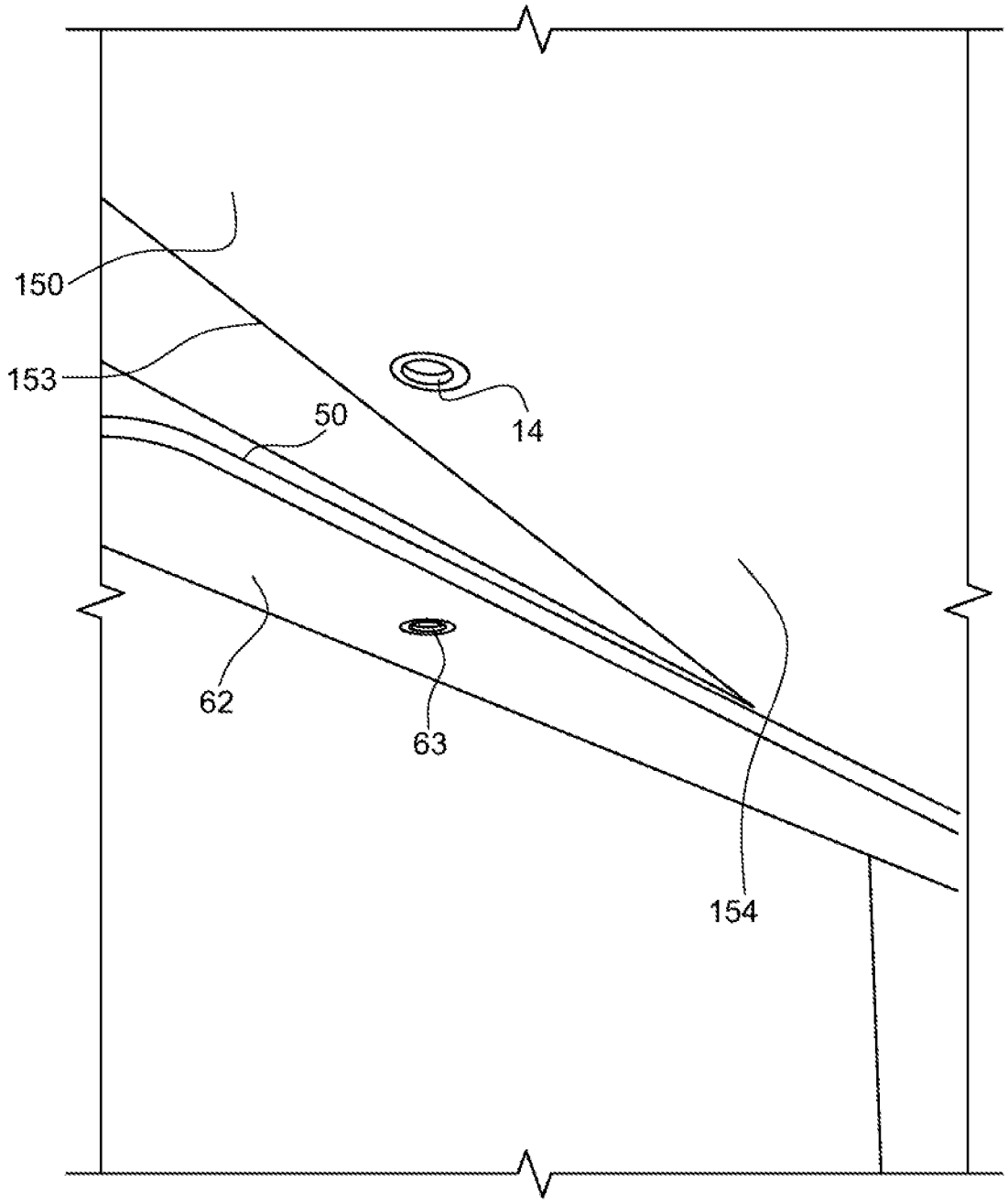
FIG. 13 is a bottom perspective view of a shelf disposed on a shelving track.

In one embodiment, as shown in FIGS. 7A, 7B, 10A, 10B, and 11, the storage container 100 is foldable, collapsible or otherwise movable between a first or erected position (FIGS. 7B, 10A, and 10B) and a second or folded position (FIGS. 7A and 11). The first and second side walls 112, 114 may include a division or crease 120 dividing the first and second side walls 112, 114 into two portions such that the first and second side walls 112, 114 may be folded in half. For example, the first and second side walls 112, 114 may each be composed of two inserts encased in a single fabric casing with sewing or stitching diving the inserts along the crease 120 or the crease may be a perforation or other division which allows the first and second side walls 112, 114 to fold. The first and second side walls 112, 114 may then be folded or pivoted along the crease 120 such that the crease 120 may be moved toward the opposite side wall 112, 114. As the first and second side walls 112, 114 are folded inwardly, the first and second end walls 108, 110 may be brought toward the other end wall 108, 110 and the folded side walls 112, 114 in a compressed manner. When the side walls 112, 114 are folded inwardly and the end walls 108, 110 are brought together, the storage container 100 may be substantially flat.

Figure 7B:
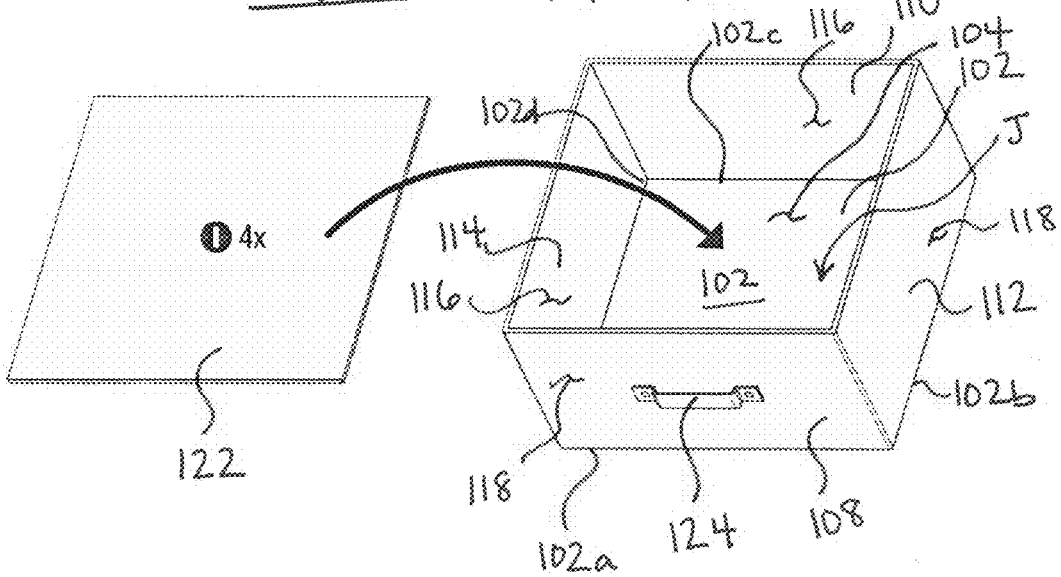
FIG. 7B is a front-top-right perspective view of the storage container of FIG. 7A in a first or erected position.
Figure 8:
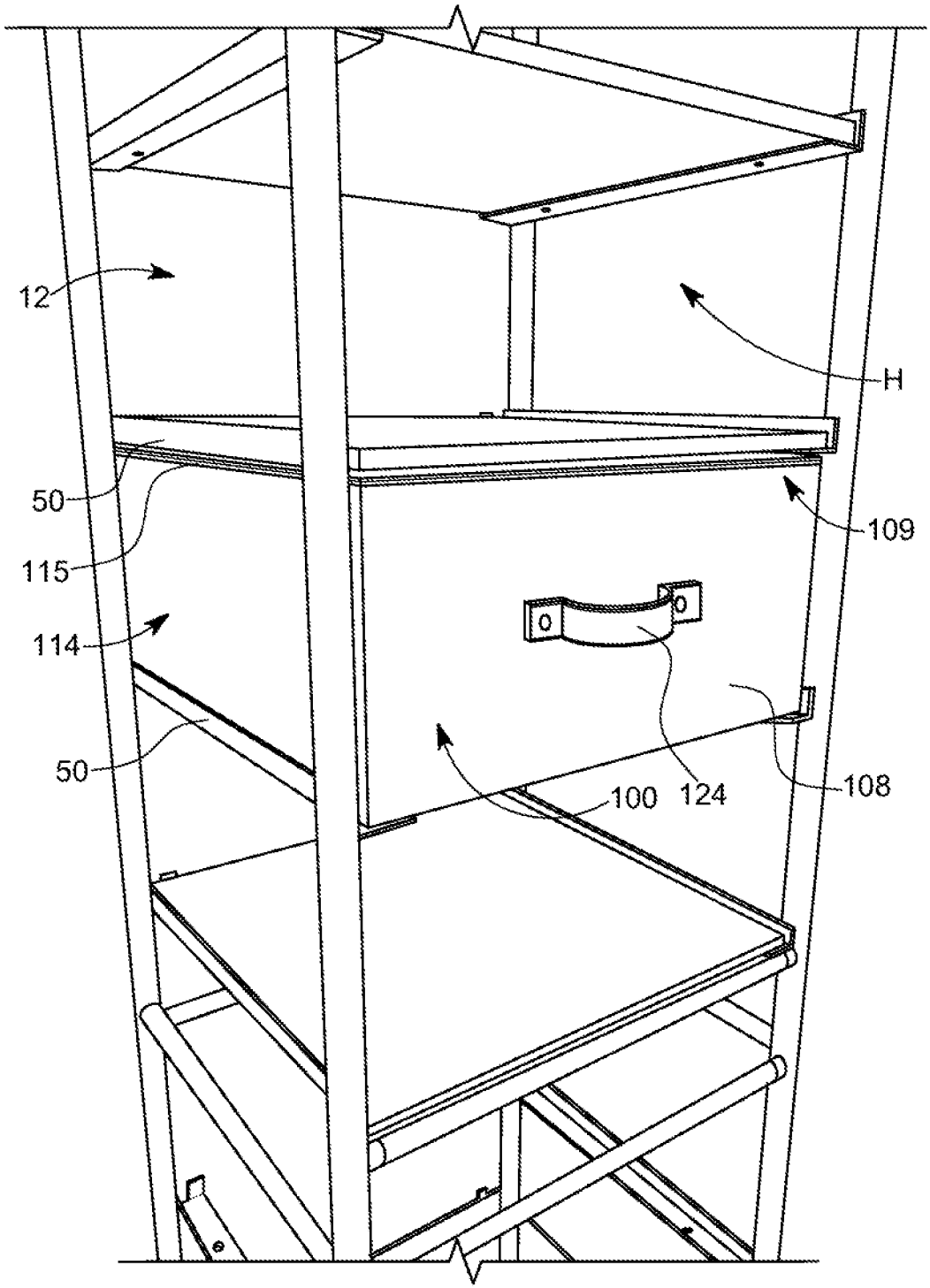
FIG. 8 is a front-left-top perspective view of the storage container of FIGS. 7A and 7B disposed in a shelf opening of a frame system.
Figure 9A:
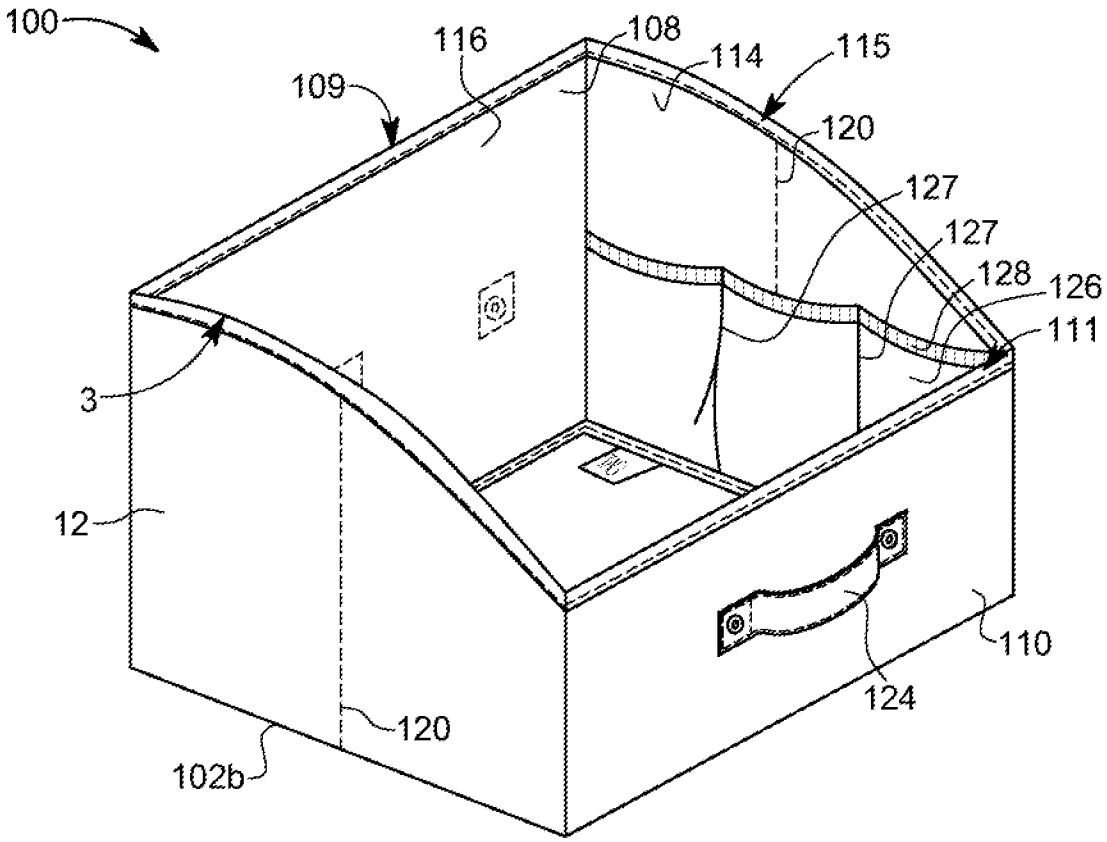
FIG. 9A is a top-rear-right perspective view of a storage container according to a second embodiment.
Figure 9B:
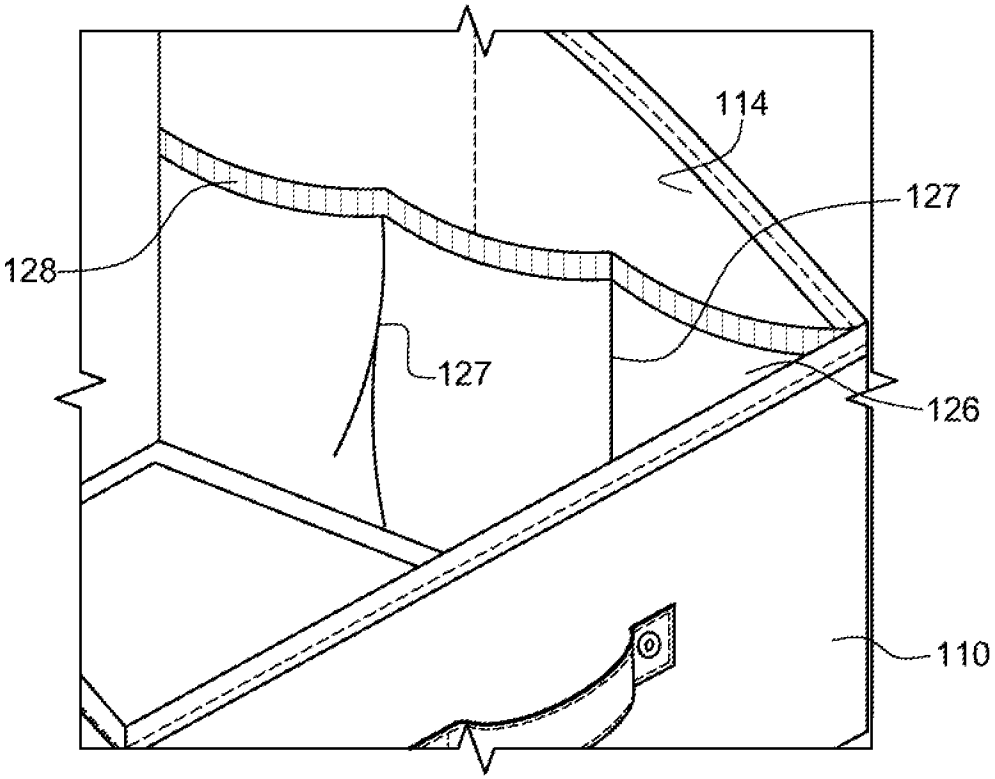
FIG. 9B is a partial top-rear-right perspective view of the storage container of FIG. 9A.
Figure 9C:
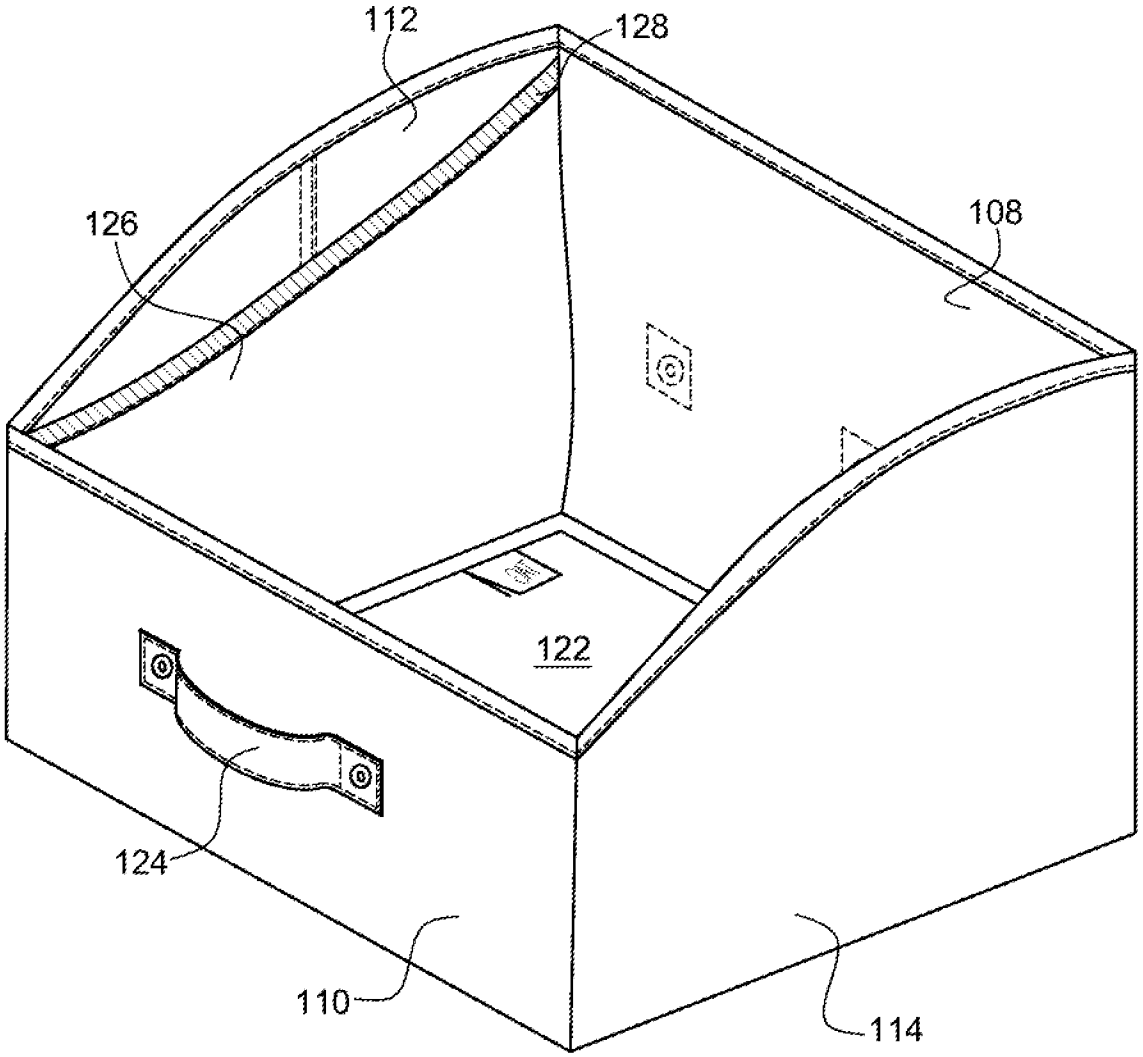
FIG. 9C is a top-rear-left perspective view of a storage container according to a third embodiment.
Figure 9D:
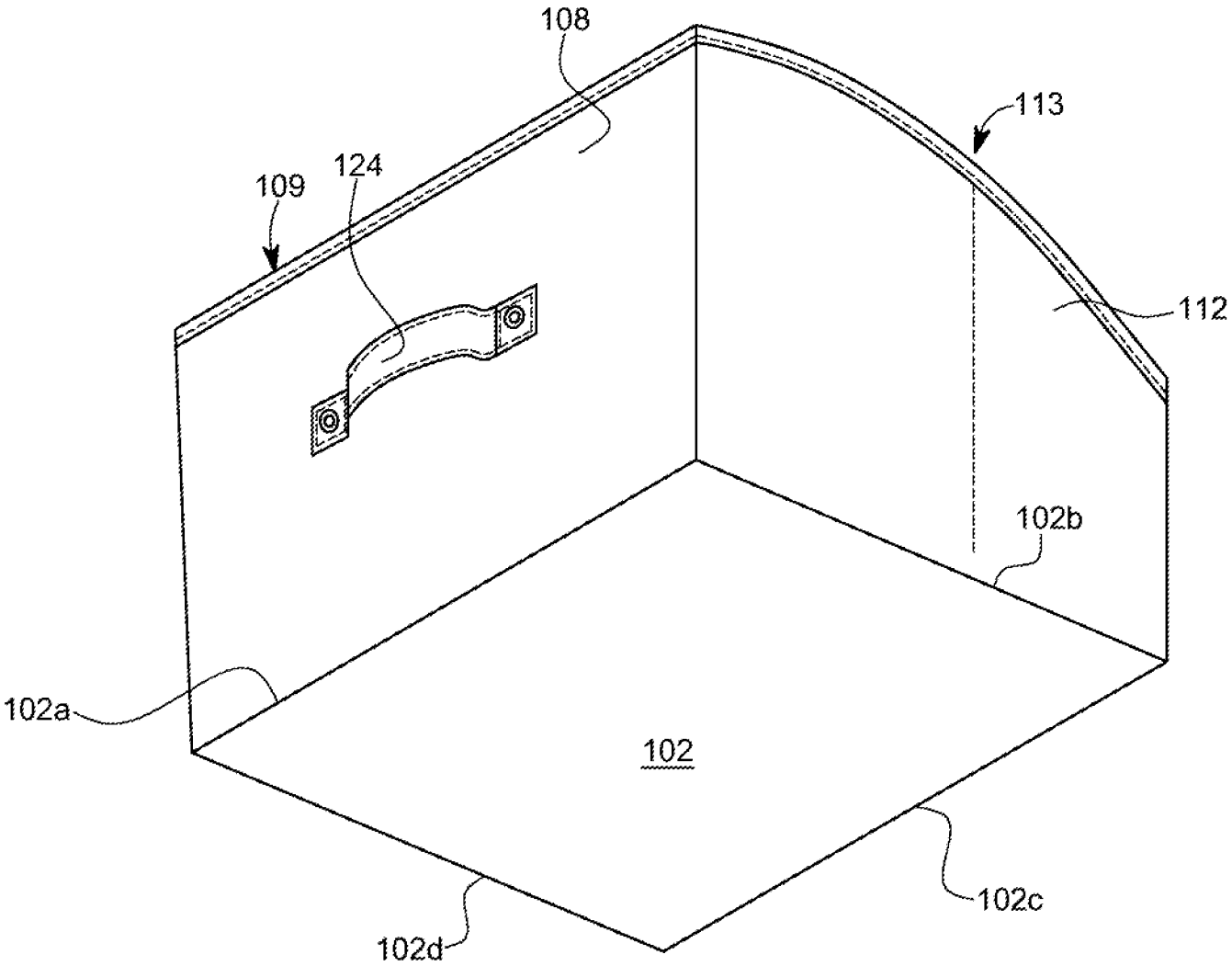
FIG. 9D is a bottom-front-right perspective view of the storage container of FIG. 9A.
Figure 9E:
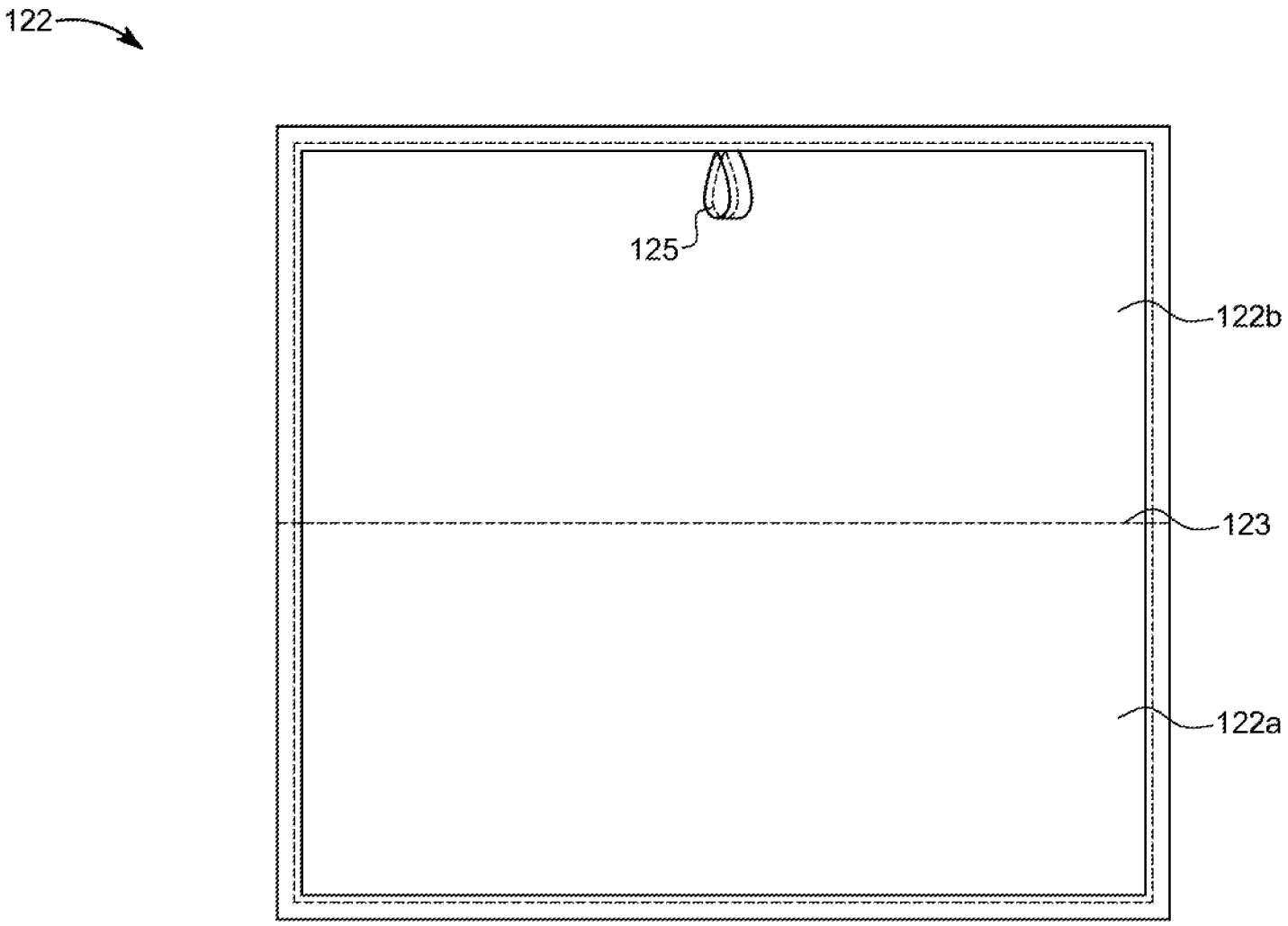
FIG. 9E is a top view of an insert for use with a storage container.
Figure 10A:
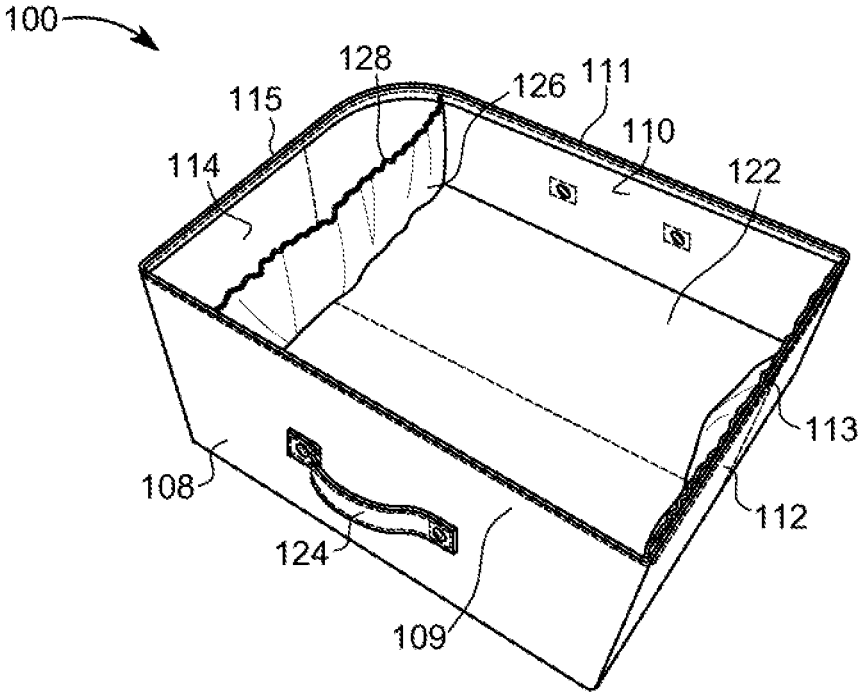
FIGS. 10A and 10B are front and rear top-right perspective views of the storage container of FIG. 9C in an erected position.
Figure 10B:
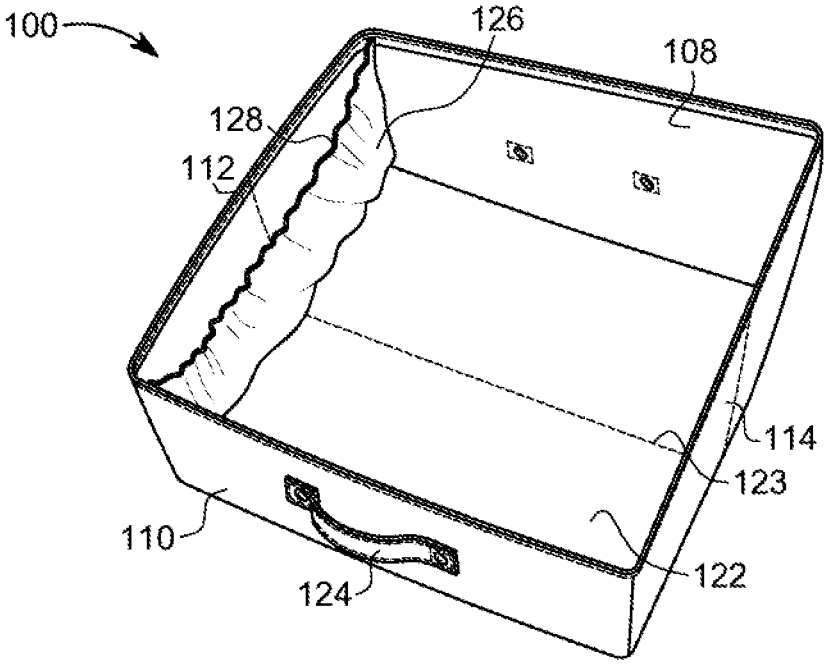

As shown in FIGS. 7B, 9A, and 9E, the storage container 100 may also include a rigid insert 122 which may be disposed in the storage container 100 when the first and second end walls 108, 110 and first and second side walls 112, 114 are erected to maintain the storage container 100 in the first or erected position. The rigid insert 122 may be substantially rectangular and planar and may be sized to be received between the first and second end walls 108, 110 and first and second side walls 112, 114 when the first and second end walls 108, 110 and first and second side walls 112, 114 are erected. The rigid insert 122 may also be sized and designed to be disposed on the base 102 of the storage container 100 and thereby prevent the first and second side walls 112, 114 from folding or pivoting inwardly. The rigid insert 122 may be constructed similarly to the end walls 108, 110 and side walls 112, 114. For example, the rigid insert 122 may be constructed of one or more inserts composed of cardboard, paperboard, cellulose, plastic, or other suitable material which is at least semi-rigid, encased in a fabric or cloth.

In an optional embodiment, the insert 122 may include a lateral fold 123 which divides the insert 122 into a first insert portion 122*a* and a second insert portion 122*b*. The first insert portion 122*a* and the second insert portion 122*b* may be two separate inserts with a stitching therebetween separating the two portions 122*a*, 122*b*. The lateral fold 123 may be oriented such that the insert 122 does not fold or collapse when the insert is disposed in the storage container 100.

As depicted in FIG. 9E, either in addition or in the alternative, the insert 122 may include a tag 125 disposed on or near an edge of the insert 122. The tag 125 extends inwardly from the edge and provides a surface which a user may grab to remove the insert 122 from the storage container 100. In the illustrated embodiment, the tag 125 is a looped piece of fabric which is sewn at both ends near the edge. However, the tag 125 may be a single strip of fabric, a clasp, a snap, or any other suitable structure which a user may grab to place or remove the insert 122. Further, the insert 122 may also include a binding around the outer edges of the insert 122. The binding may be fabric, cloth, or other suitable material.

In one embodiment, the storage container 100 may be sized, shaped, and designed such that the storage container 100, when in the first or erected position, may be inserted into one of the shelf openings H of the frame system 12 along the shelving tracks 50 with either the first end wall 108 or second end wall 110 facing outwardly from the shelf opening H and with the other of the first and second end walls 108, 110 abutting the stop flange 64 of the shelving tracks 50. As such, either the first end wall 108 or the second end wall 110 may define a front face of the shelf opening H. When the first end wall 108 defines the front face of the shelf opening H, the first end wall 108 extends to substantially the same height as the shelving tracks 50 or connector bar 18 successive above the shelving tracks 50 on which the storage container 100 is disposed. As such, the contents and interior of the storage container 100 would not be visible to a user when the storage container 100 is fully inserted into the shelf opening H. When the second end wall 110 defines the front face of the shelf opening H, there is a gap between the top of the second end wall 110 and the shelving tracks 50 successively above the shelving tracks 50 on which the storage container 100 is disposed. As such, the contents and interior space J of the storage container 100 may be visible to a user when the storage container 100 is fully inserted into the shelf opening H.

In an optional embodiment, the first end wall 108 and/or the second end wall 110 may have a handle 124 disposed on the exterior face 118. The one or more handles 124 may be designed such that a user may grasp one of the handles 124 with his or her hand and move the storage container 100. The handle 124 may allow a user to push, pull, or otherwise move the storage container 100 in and out of the shelf opening H. In the illustrated embodiment, the handles 124 are attached to the first and second end walls 108, 110 by two rivets extending through opposite ends of the handle 124 through the handle 124 and into the end wall 108, 110. However, in other embodiments, the handle 124 may be attached or secured to the exterior face 118 of the first or second end wall 108, 110 by fasteners, glue, or other suitable attachment means.

As shown in FIGS. 9A-12B, when the first height 109 is different than the second height 111, the first and second top edges 113, 115 of the first and second side walls 180, 110 may be rounded or otherwise curved such that the height of the first and second side walls 112, 114 varies between the sides near the first end wall 108 where the height of the first and second side walls 112, 114 is substantially equivalent to the height of the first end wall 108 and the sides near the second end wall 110 where the height of the first and second side walls 108, 110 is substantially equivalent to the height of the second end 110. However, the top edge of the first and second side walls 112, 114 may have other shapes or constructions. For example, the top edge of the first and second side walls 112, 114 may be curved or rounded in the opposite direction, stepped, diagonal, tiered, or any other suitable shape or construction.

The storage container 100 may also include one or more liners 126 disposed in the interior space J of the storage container 100 along the first and/or second side walls 112, 114. The liners 126 may be secured or attached to the interior space J of the storage container 100 along three sides of the liner 126 such that the liner 126 defines a pocket with the interior of the storage container 100. The liner 126 may be secured to the storage container 100 along the crease between the base 102 and the first or second side wall 112, 114, along the corner formed between the first end wall 108 and the first or second side wall 112, 114, and along the corner formed between the second end wall 110 and the first or second side wall 112, 114. As such, the liner 126 defines a pocket having an opening facing the top of the storage container 100. The liner 126 may be cloth, mesh, plastic, or other suitable fabric. The liner 216 may also have an elastic band 128 within or attached to the top portion of the liner 126 such that the opening of the liner 126 may be biased toward the first or second side wall 112, 114. The pocket formed between the liner 126 and the interior of the storage container 100 may store smaller items such as jewelry, socks, underwear, or any other similarly sized items.

As illustrated in FIGS. 9A and 9B, the liner 126 may include one or more dividers 127 which vertically connect the liner 126 to the adjacent side wall 112, 114 and divide the space between the liner 126 and the adjacent side wall 112, 114 into two or more pockets. In the illustrated embodiment, the storage container 100 includes two dividers 127 which attach the liner 126 to the second side wall 114. The liner 126 extends about 4.75 inches from the bottom 102 of the storage container 100 and the dividers 127 are about 5.125 inches and about 10.25 inches from the first end wall 108, respectively. The pocket nearest the first end wall 108 is about 5.125 inches wide and the liner 126 is about 7.125 inches wide between the first end wall 108 and the first divider 127.

As illustrated in FIG. 9C, the liner 126, as depicted in FIG. 9C, the liner 126 may not include any dividers 127 such that the liner 126 creates a single pocket. In the illustrated embodiment, the liner 126 is disposed adjacent the first side wall 112 and has a length of about 15.5 inches and the length of the fabric of the liner liner 126 is about 22 inches. The liner 126 has a height near the first end wall 108 which is substantially the same height as the first height 109 and a height near the second end wall 110 which is substantially the same height as the second height 111.

While the liners 126 have been described as being disposed along the first and second side walls 112, 114, the liners 126 may be similarly disposed along the first and/or second end walls 108, 110, either in addition to or instead of being disposed along the first and second side walls 112, 114.

In a second embodiment, either alternatively or additionally to the storage system 10 with storage containers 100, the storage system 10 may include one or more shelves 150. The shelves 150 may be a generally rectangular plate and each shelf 150 may include an upper face 152, a lower face 154 opposite the upper face 152, side surfaces 153 extending between the upper and lower faces 152, 154 along the sides of the shelf 150, and end surfaces 155 extending between the upper and lower faces 152, 154 at the front and rear of the shelf 150. The upper and lower faces 152, 154 may have a width substantially equivalent to the distance between the vertical walls 52 of the shelving frames 50 attached to the first and second side frames 14, 16 and a depth substantially equivalent to the depths of the shelving tracks 50. The shelves 150 are designed and constructed to be disposed on the top face 60 of the horizontal wall 58 by two shelving tracks 50 defining a shelf opening H and support items such as clothing, jewelry, shoes, decorations, or other items on the shelf 150. The shelves 150 may be made of wood, metal, paperboard, plastic, or other suitable material. Further, the shelves 150 may be made of the same material as the top plate 74 and/or made to look similar to the top plate 74.

Each shelf 150 may have one or more shelf bores 156 disposed in the lower face 154 and extending toward the upper face 152. In one embodiment, the shelf bores 156 are threaded. In other embodiments, the shelf bores 156 are not threaded. The shelf bores 156 may be inset from the side surfaces 153 and disposed on the lower face 152 along the length of the side surface 153. The shelf bores 156 may align with the shelf apertures 63 of the shelving tracks 50 when the shelf 150 is disposed in the shelf opening H on two shelving tracks 50. A screw, bolt, nail, or other suitable fastener may be inserted through the shelf aperture 63 and into the shelf bore 156 to secure the shelf 150 in the frame system 12.

In use, the storage container 100 or shelf 150 may be inserted into the shelf opening H with a portion of the bottom surface 106 of the base 102 the storage container 100 or of lower surface 154 of the shelf 150 disposed on the top face 60 of the shelving tracks 50. The storage container 100 or shelf 150 may be pushed or slid into the shelf space H until a portion of the storage container 100 or shelf 150 abuts the stop flange 64 of the shelving tracks 50.

Turning to FIGS. 14-18B, an exemplary rod attachment system 200 is depicted. The rod attachment system 200 includes a bar or rod 202, a fastener 212, and a connector 224. The rod attachment system 200 may be secured to the frame system 12 and the mount 260 such that a user may hang clothing or other items from the rod 202.

Figure 14:
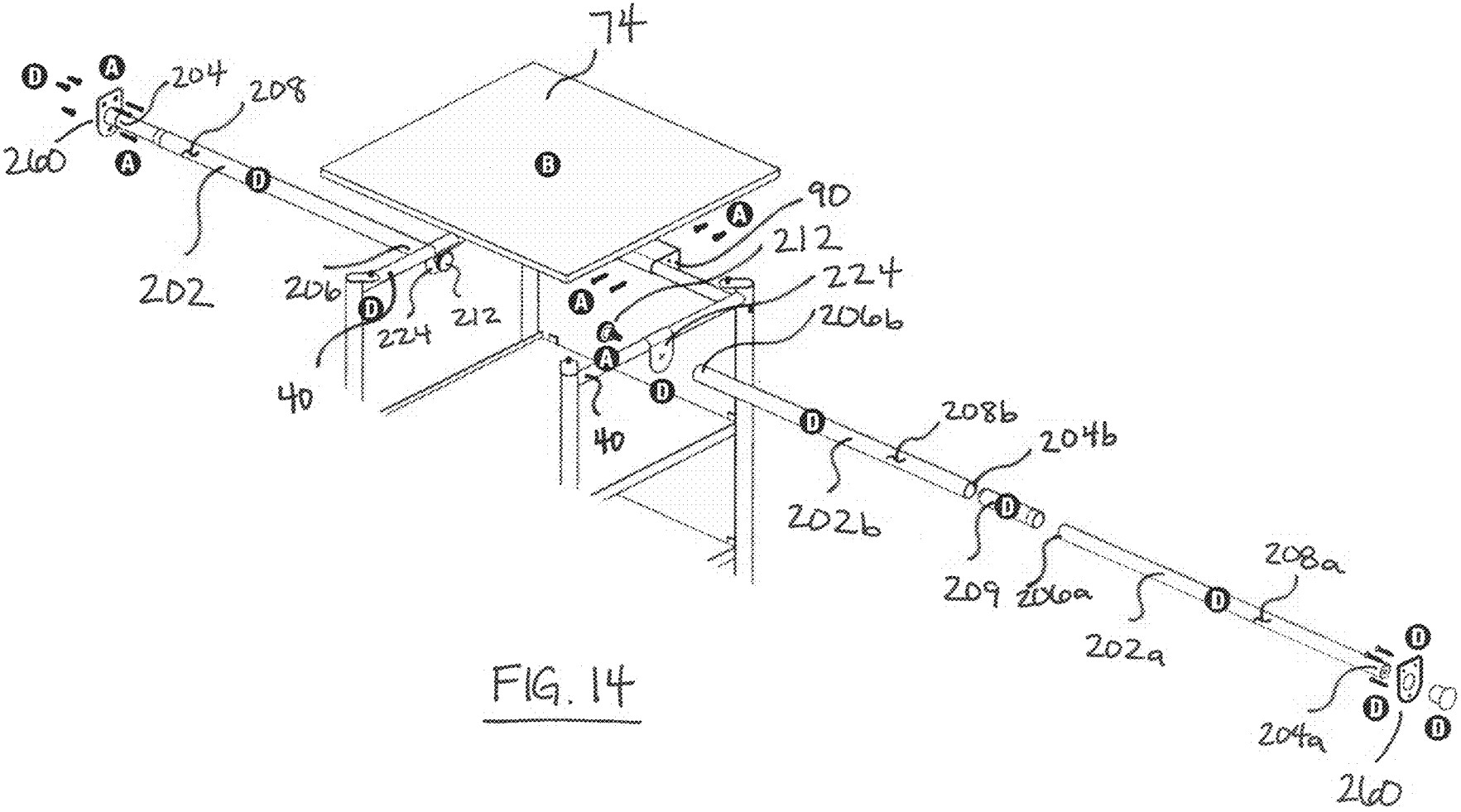
FIG. 14 is a top-front-right perspective view of an exemplary rod attachment system.
Figure 15:
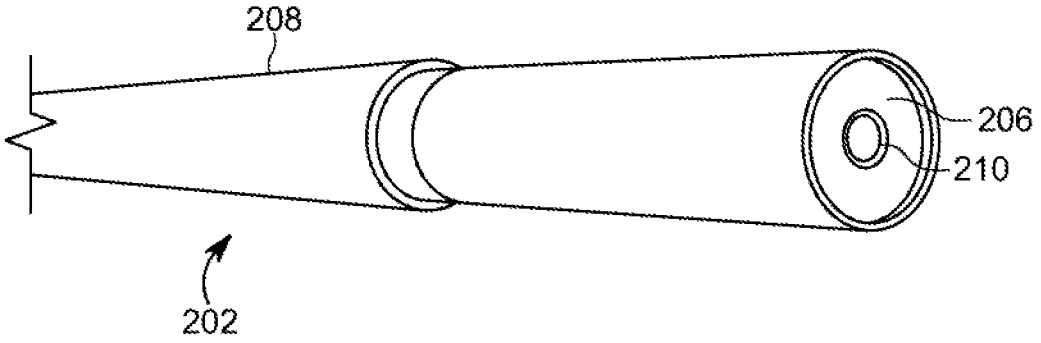
FIG. 15 is a front-right perspective view of a second end of a rod.

As shown in FIGS. 14 and 15, the rod 202 is a generally cylindrical tube having a first end 204, a second end 206, and an outer circumferential surface 208. The first and second ends 204, 206 may be substantially circular and the outer circumferential surface 208 may be sized similarly to traditional closet rods and/or sized to hang clothing hangers. For example, the outer circumferential surface may have a diameter between about 1.0 and about 2.0 inches, such as between about 1.25 and about 1.625 inches. The outer circumferential surface 208 may have a reduced diameter near the first end 204 such that the first end 204 of the rod 202 may be received in the mount 260, as detailed below. The second end 206 has a receiving portion 210 which may extend into the rod 202 and may receive a portion of the fastener 212. In one embodiment, the receiving portion 210 is a threaded bore or passage which extends inwardly into the rod 202 from the second end 208. However, as detailed below, the receiving portion 210 may be other suitable constructions or designs which may secure and/or interlock the rod 202 with the fastener 212.

In one embodiment, the rod 202 is telescoping and has a first rod portion 202*a* having a first end 204*a*, a second end 206*a*, and a first outer circumferential surface 208*a* and a second rod portion 202*b* having a first end 204*b*, second end 206*b*, and a second outer circumferential surface 208*b*. The first outer circumferential surface 208*a* may have a diameter smaller than a diameter of the second outer circumferential surface 208*b* such that the second end 206*a* of the first rod portion 202*a* may fit within the first end 204*b* of the second rod portion 202*b* such that the rod 202 may telescope to different lengths. In such an embodiment, the rod 202 may further include a locking mechanism 209 which may secure the first rod portion 202*a* within the second rod portion 202*b* to fix the length of the rod 202. For example, the locking mechanism 209 may be a clamping mechanism which clamps the first and second rod portions 202*a*, 202*b* together when the first and/or second rod portion 202*a*, 202*b* is radially twisted, snaps, screws, bolts, or other fasteners, or any other suitable locking mechanisms. However, in other embodiments, the rod 202 is a substantially solid bar or cylinder which does not telescope or otherwise vary in length.

Figure 16A:
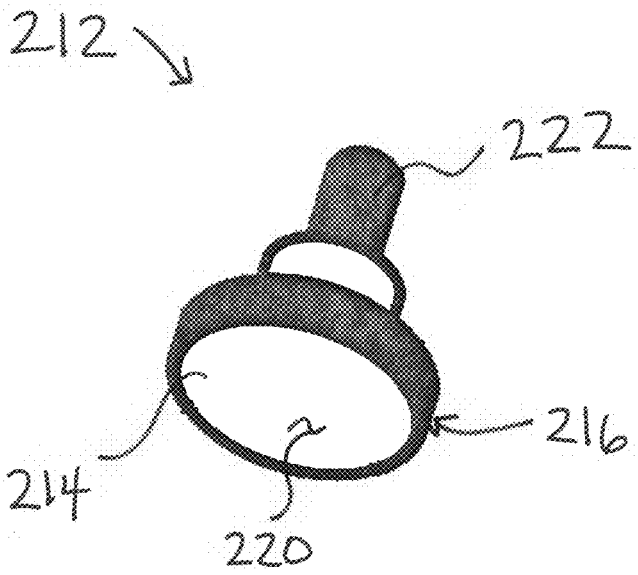
FIGS. 16A and 16B are perspective views of an exemplary fastener.
Figure 16B:
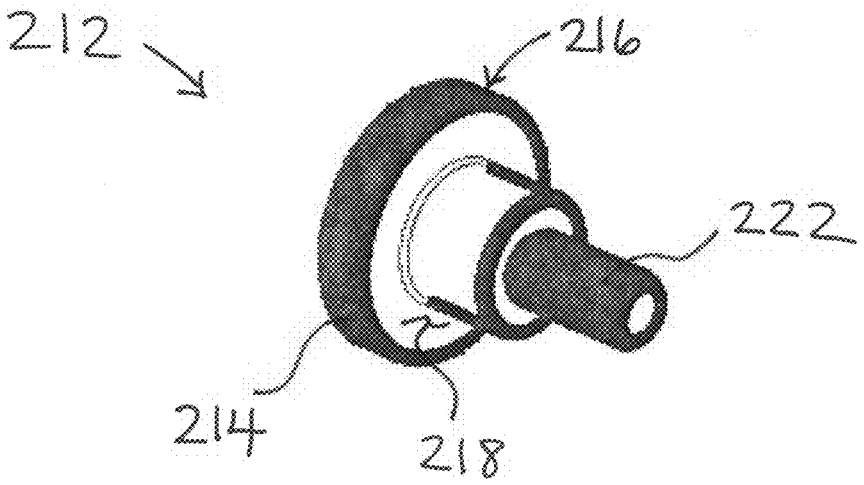

As shown in FIGS. 16A and 16B, the fastener 212 has a cap portion 214 having an outer surface 216 with a first diameter, a proximal surface 218, and a distal surface 220 opposite the proximal surface 218 and a projection portion 222 extending from the proximal surface 218 and having a second diameter, the first diameter being larger than the second diameter. The outer surface 216 of the cap portion 214 may be raised, ridged, textured, or otherwise designed to allow a user to grip and/or twist the fastener 212. The projection portion 222 is shaped, sized, and designed to fit through the connector 224 and be received in, interlock with, and/or secured in the receiving portion 210 of the rod 202. In one embodiment, the projection portion 222 is threaded such that the projection portion 222 may be threadingly received and secured in the receiving portion 210 of the rod 202. However, the projection portion 222 and receiving portion 210 may be secured and/or interlocked together by other suitable mechanisms. For example, the projection portion 222 may have on or more spring loaded latches, the projection portion 222 and receiving portions 210 may have a magnetic connection, the projection portion 222 and the receiving portion 210 may have shapes or geometries which interlock together when at least the projection portion 222 or the receiving portion or twisted, or the projection portion 222 and receiving portion 210 may be secured together by bolts, snaps, screws, nails, or other suitable fasteners.

Figure 17A:
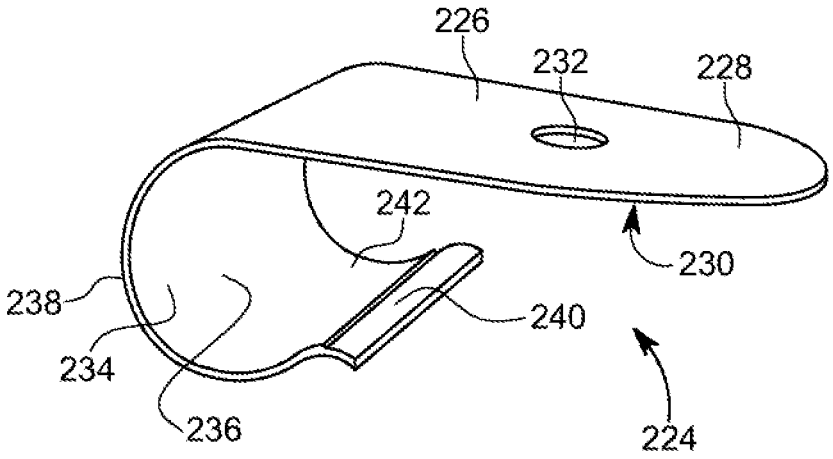
FIGS. 17A and 17B are perspective views of an exemplary connector.
Figure 17B:
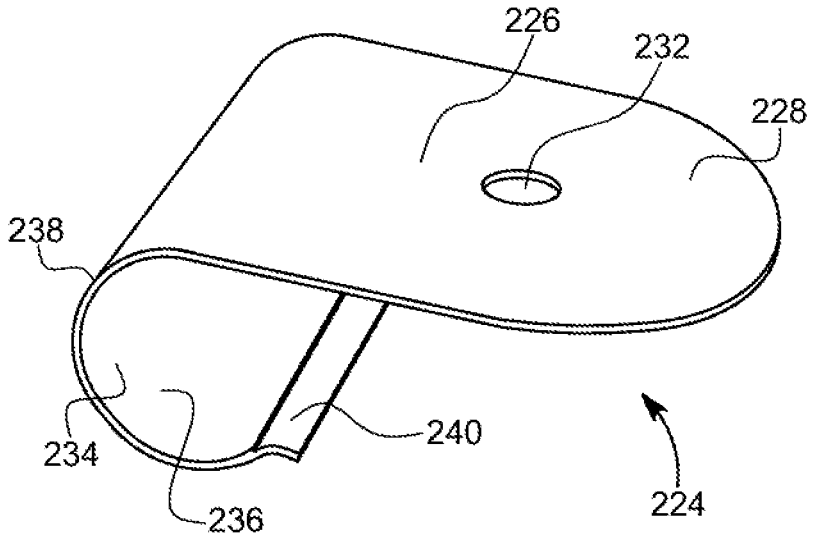

As shown in FIGS. 17A and 17B, the connector 224 has a planar portion 226 and an arcuate portion 234 having an inside surface 236 and an outside surface 238. The arcuate portion 234 is sized and shaped to securely fit over one of the support rods 40 and may be at least a half circle. The connector 224 is sized and shaped such that the planar portion 226 hangs substantially vertically when the arcuate portion 234 is disposed on one of the support rods 40. The planar portion 226 has a distal surface 228, a proximal surface 230 opposite the distal surface 228, and an aperture 232 extending through the planar portion 226 from the distal surface 228 to the proximal surface 230. In one embodiment, the arcuate portion 234 terminates in a flange 240 extending radially and outwardly from the remainder of arcuate portion 234 and opposite the planar portion 226. In an additional or alternative embodiment, the connector 224 may also include a pad 242 disposed which secures the attachment of the of the connector 224 on the support rod 40 and/or protects the connector 224 and support rod 40 when the rod attachment system 200 is attached to the frame system 12, as detailed below. The inside surface 236 of the arcuate portion 234 and/or the pad 242 may be sized and shaped to snugly fit around the outer circumferential rod surface 46 of the support rod 40.

Figure 19:
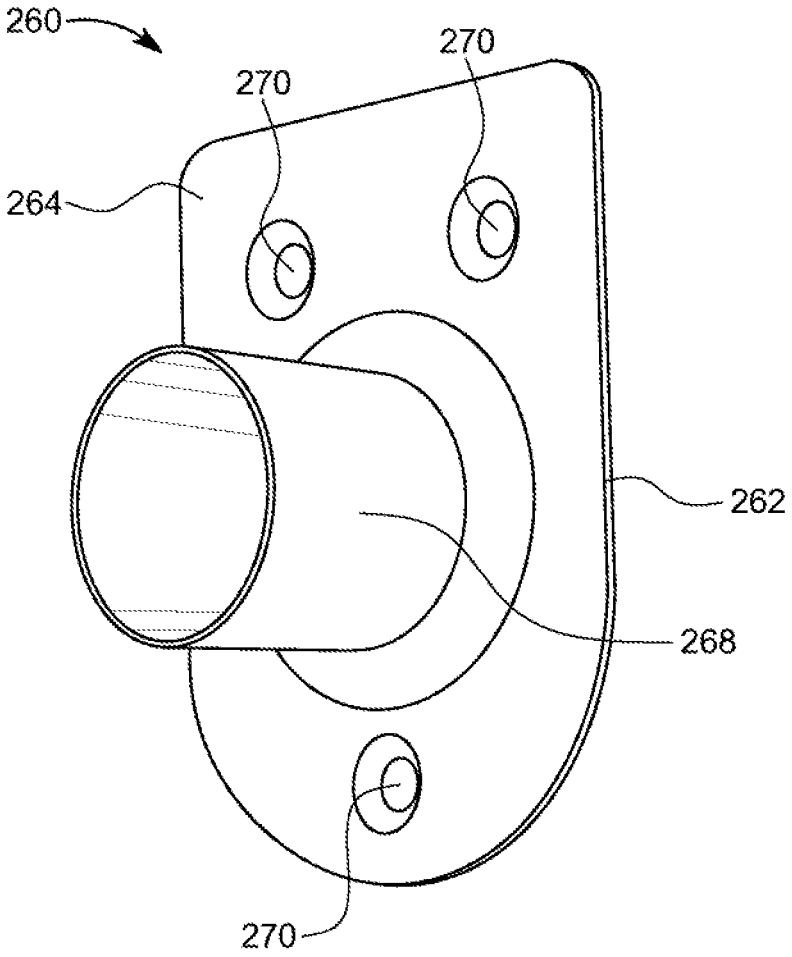
FIG. 19 is a front-right perspective view of a mount according to one embodiment.

Turning to FIG. 19, an exemplary mount 260 is depicted. The mount 260 may be secured to a wall or similar surface and may secure the first end 204 of the rod 202. The mount 260 may have mount plate 262 having a proximal surface 264 and a distal surface 266 (not pictured), a rod receiving portion 268 extending proximally from the proximal surface 264 of the mount plate 262, and one or more mount apertures 270 in the mount plate 262. The mount plate 262 may be substantially vertical such that the distal surface 266 may be disposed flush against a wall or similar surface. The rod receiving portion 268 extends proximally from the proximal surface 264 of the mount plate 262 to receive, interlock with, or secure the first end 204 of the rod 202. The mount apertures 270 may accommodate one or more screws, bolts, nails, or other suitable fasteners to secure the mount 260 to a wall or similar surface and may be disposed in the mount plate 262 around the rod receiving portion 268 to support the mount plate 260 and the rod 202 when the rod 202 is loaded with hanging clothes and similar items. In the illustrated embodiment, the rod receiving portion 268 is a hollow cylinder which is sized to securely receive the first end 204 of the rod 202. However, the rod receiving portion 268 may have other designs, shapes, or constructions to suitably secure the mount 260 and the rod 202. For example, the rod receiving portion 268 may be J- or U-shaped such that the first end 204 of the rod 202 may be gravitationally secured in the rod receiving portion, the first end 204 of the rod 202 may have a threaded projection which is threadingly secured in a threaded bore in the rod receiving portion 268, the rod receiving portion 268 may have a threaded projection which is threadingly secured in a threaded bore in the first end 204 of the rod 202, the rod 202 and/or rod receiving portion 268 may have spring loaded latches, groves, projections, or other similar designs which may interlocking secure the rod 202 and rod receiving portion 268 together, or the rod 202 and the rod receiving portion 268 may secured by screws, snaps, bolts, magnets, or other suitable fasteners.

Figure 18A:
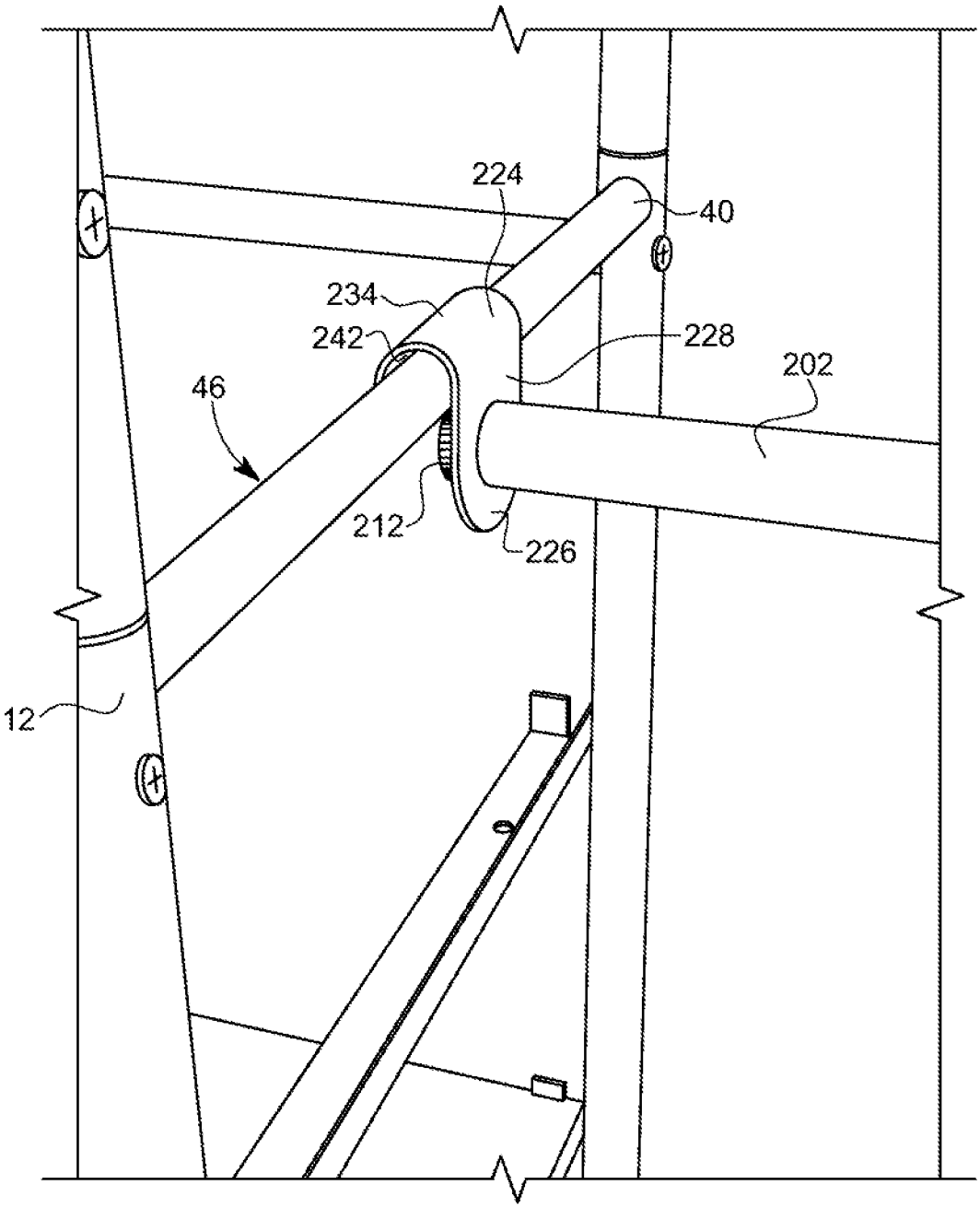
FIGS. 18A and 18B are perspective views of the rod attachment system of FIG. 14 attached to a support rod of a frame system.
Figure 18B:
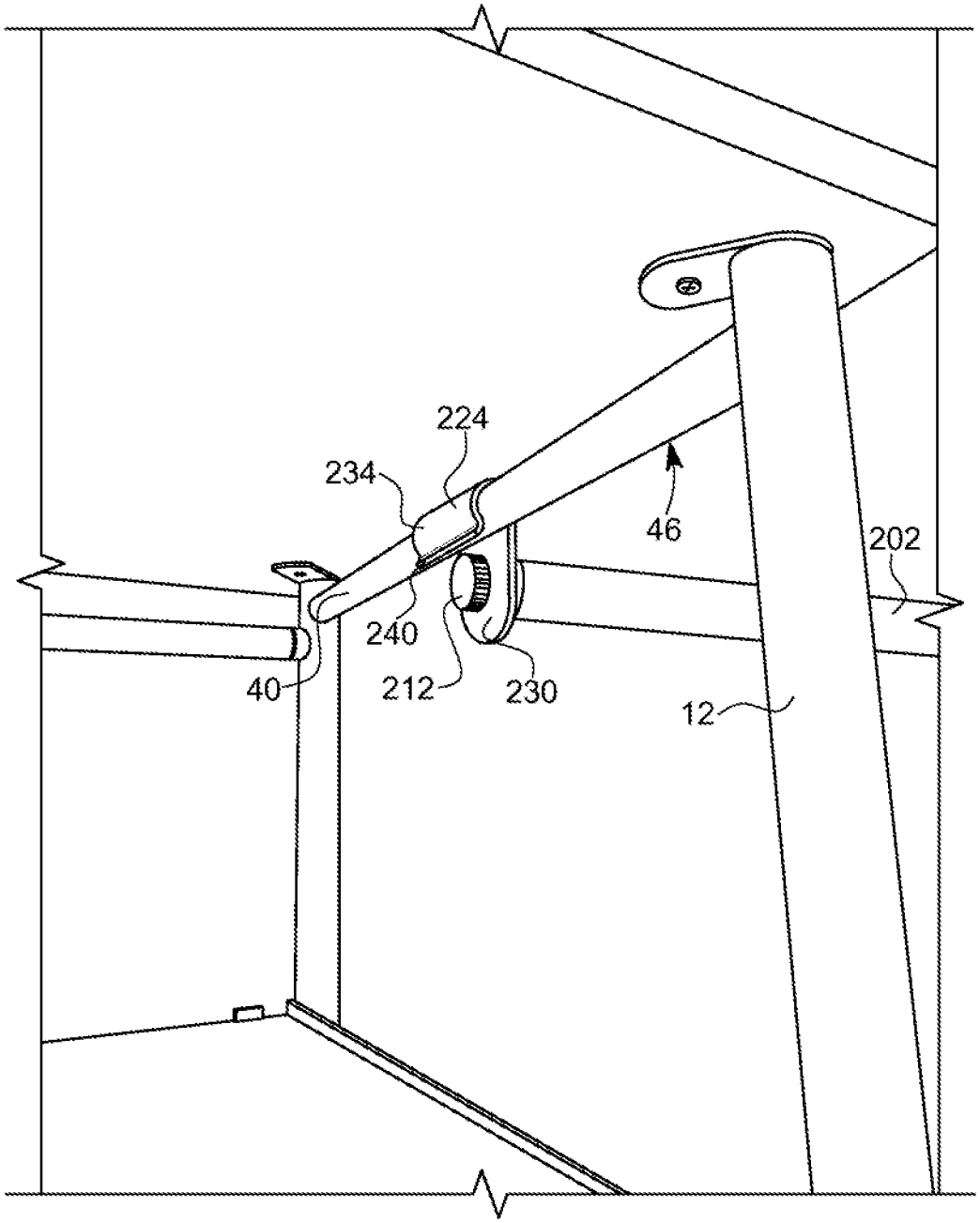

Referring to FIGS. 14, 18A, and 18B, the rod attachment system 200 may be connected, secured, or attached between the mount 260 and any of the support rods 40 of the frame system 12. For example, in FIG. 14, a first rod 202 for hanging items such as garments from hangers extends to the left from the top, left support rod 40 and a second rod 202 for hanging items such as garments from hangers extends to the right from the top, right support rod 40 to give two tall areas for hanging garments of just about any length. In FIGS. 18A and 18B, a first rod 202 extends to the right from the top, right support rod 40 (FIG. 18B) and a second rod 202 extends to the right from the middle, right support rod 40 (FIG. 18A, support rod 40 right above the drawers in FIG. 5A) to give two shorter areas for hanging garments that take up less vertical space, such as blouses, shirts, and pants. To connect the rod attachment system 200 between the mount 260 and frame system 12, the frame system 12 is constructed and the connector 224 is hung from one of the support rods 40 such that the arcuate portion 234 of the connector 224 is disposed on top of the support rod 40 and the planar portion 226 hangs below the support rod 40. In a preferred embodiment, the connector 224 is placed substantially half way along the length of the support rod 40. The flange 240 of the arcuate portion 234 facilitates the placement of the connector 224 around the support rod 40. In the illustrated embodiment, the connector 224 is disposed on the support rod 40 such that the distal surface 228 faces away from the frame system 12. However, the connector 224 may be disposed on the support rod 40 such that either the distal or the proximal surface 228, 230 of the connector 224 faces away from the frame system 12.

The mount 260 may be secured to a wall or similar surface at a height and position which is aligned with the aperture 232 in the planar portion 226 of the connector 224 when the connector 224 is hung from the support rod 40 such that the rod receiving portion 268 and the surface of the planar portion 226 extending away from the frame system 12 are directly facing each other. If the rod 202 is telescoping, the first and second rod portions 202*a*, 202*b* may be adjusted so that the rod 202 is expanded or contracted to correspond to the distance between the rod receiving portion 268 and the planar portion 226 of the connector 224 and the second end 206 of the rod 202 may be positioned such that the second end abuts or nearly abuts the planar portion 226 and the receiving portion 210 of the rod 202 is aligned with the aperture 232. The projection portion 222 of the fastener 212 may be inserted through the aperture 232 in the connector 224 from the side of the planar portion 226 opposite the rod 202 and the projection portion 222 may be secured in the receiving portion 210 of the rod 202.

Once the projection portion 222 of the fastener 212 is secured through the connector 224 in the receiving portion of the rod 202, the rod 202 may be gravitationally secured between the mount 260 and the frame system 12. As the outer surface 216 of the cap portion 214 of the fastener 212 is larger than the aperture 232 of the connector 224, the fastener 212 will not come through the connector 224 and the rod 202 may remain secured. Further, as the pad 242 of the connector 224 may be disposed between the arcuate portion 234 of the connector 2242 and the support rod 40, the pad 242 may prevent the connector 224 from sliding along the length of the support rod 40 and may protect the connector 224 and support rod 40 when the weight of hanging clothes or similar items is applied to the rod 202.

In the illustrated embodiment, the rod attachment system 200 is attached to the support rod 40 of the second side frame 16 of an upper pair of side frames 14*b*, 16*b*. However, the rod attachment system 202 may be attached to the frame system 12 at any of the support rods 40 of the frame system 12. For example, the connector 224 may be disposed on the support rod 40 of the lower or upper first side frame 14*a*, 14*b* or the support rod 40 of the lower or upper second side frame 16*a*, 16*b*.

Further, while the storage system 10 has been described as having one rod attachment system 202 and one mount 260, the storage system 10 may have any other number of rod attachment systems 200 and mounts 260. For example, the storage system 10 may have two, three, four, or more rod attachment systems 200 which may be attached to any one or more of the support rod 40 of the lower first side frame 14*a*, the support rod 40 of the upper first side frame 14*b*, the support rod 40 of the lower second side frame 16*a*, and the support rod 40 of the upper second side frame 16*b* and secured to a corresponding mount 260.

Figure 20:
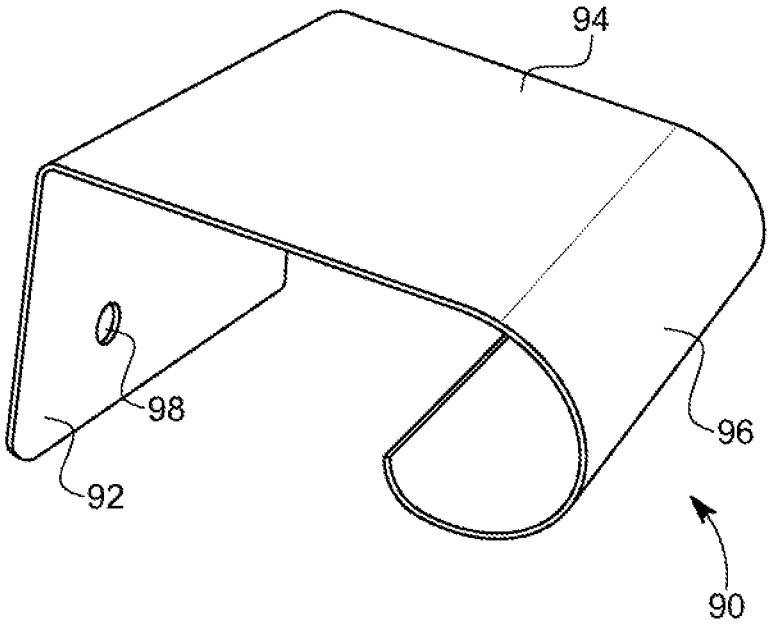
FIG. 20 is a right-top-front perspective view of a wall bracket according to one embodiment.
Figure 21A:
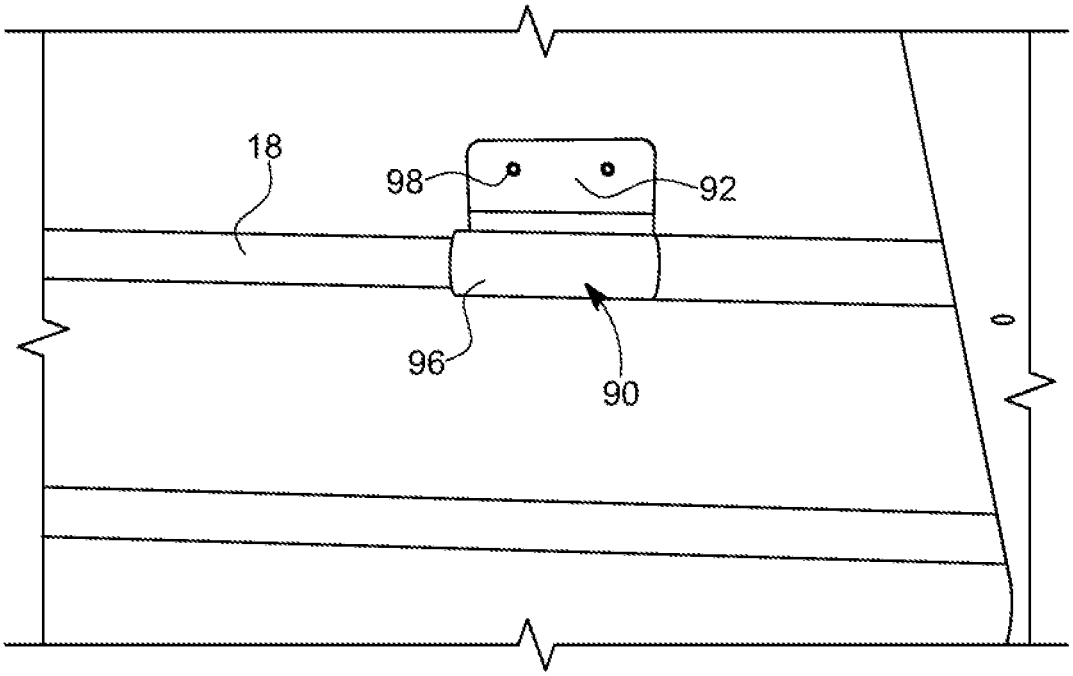
FIGS. 21A and 21B are perspective views of the wall bracket of FIG. 20 connected to a frame system.
Figure 21B:
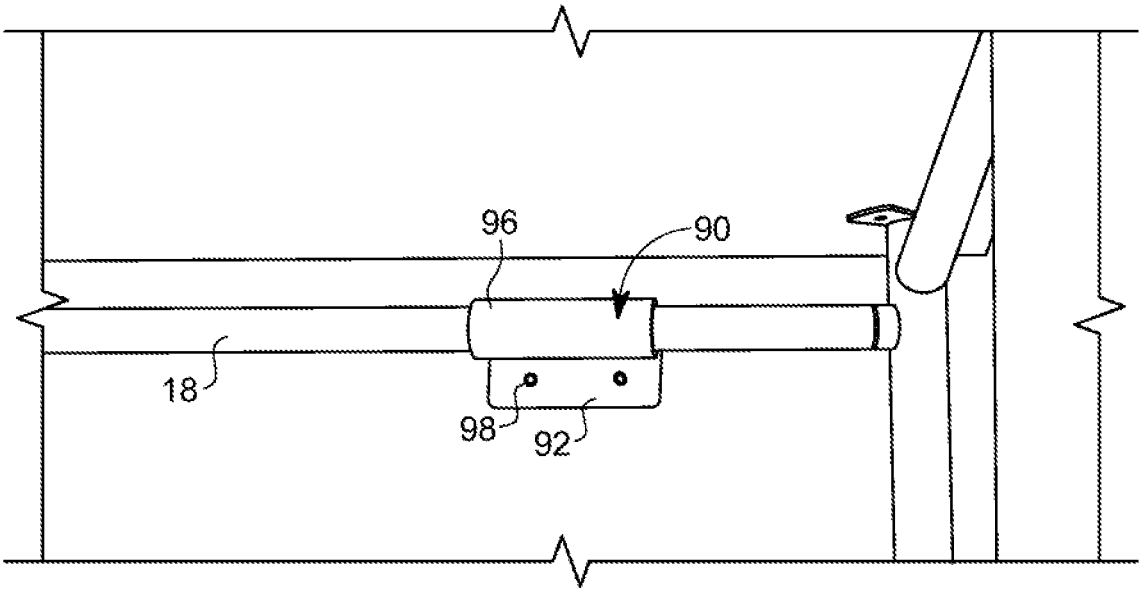
Figure 22:
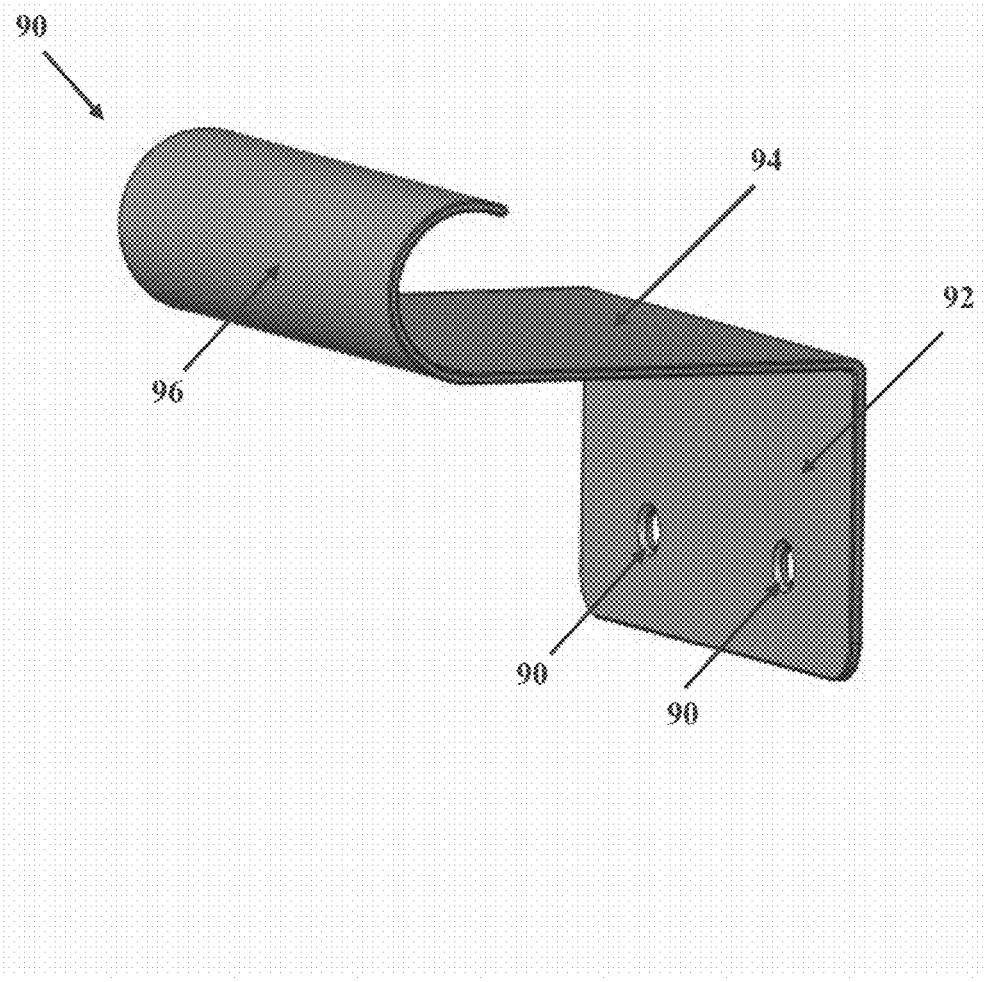
FIG. 22 is a perspective view a wall bracket according to a second embodiment.
Figure 23A:
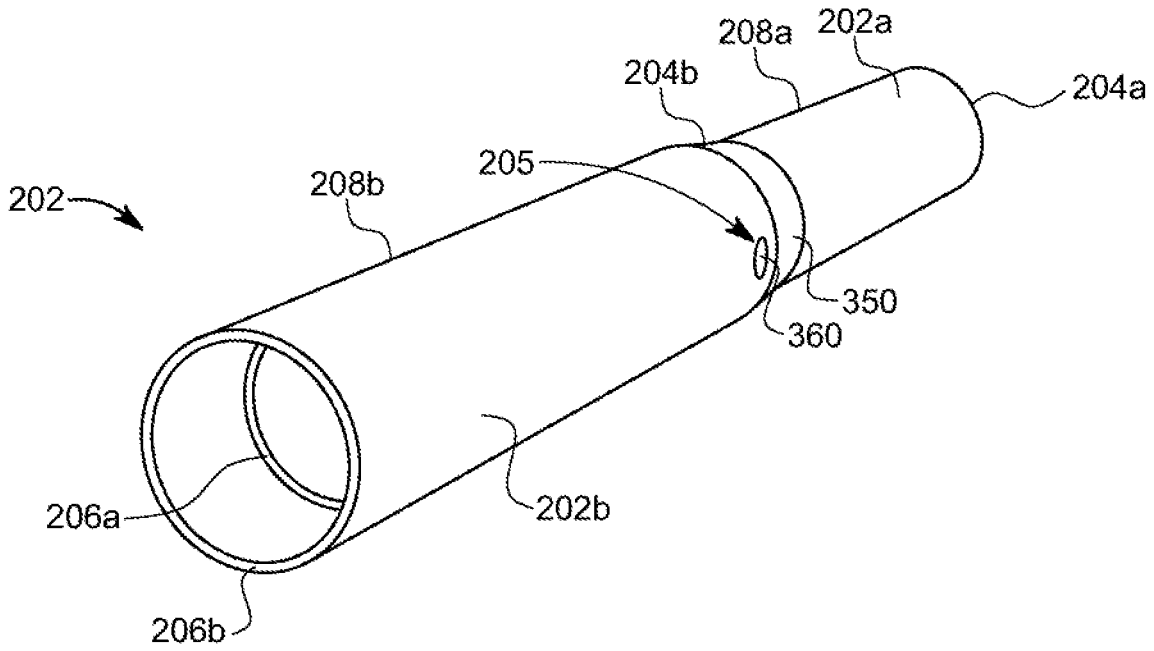
FIG. 23A is a perspective view of a rod having a rod insert and a rod sleeve.
Figure 23B:
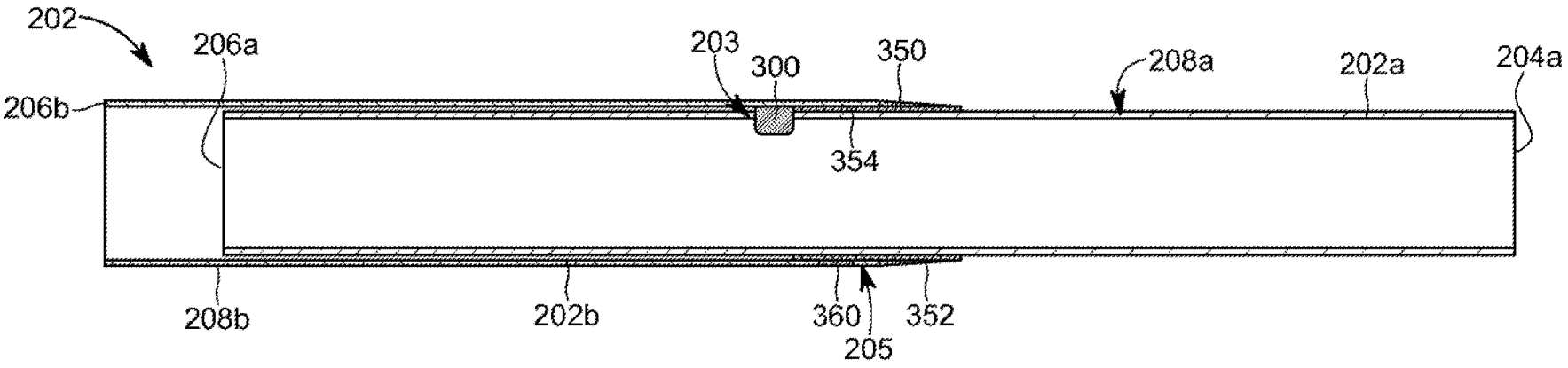
FIG. 23B is a cross-sectional side view of the rod of FIG. 23A.
Figure 23C:
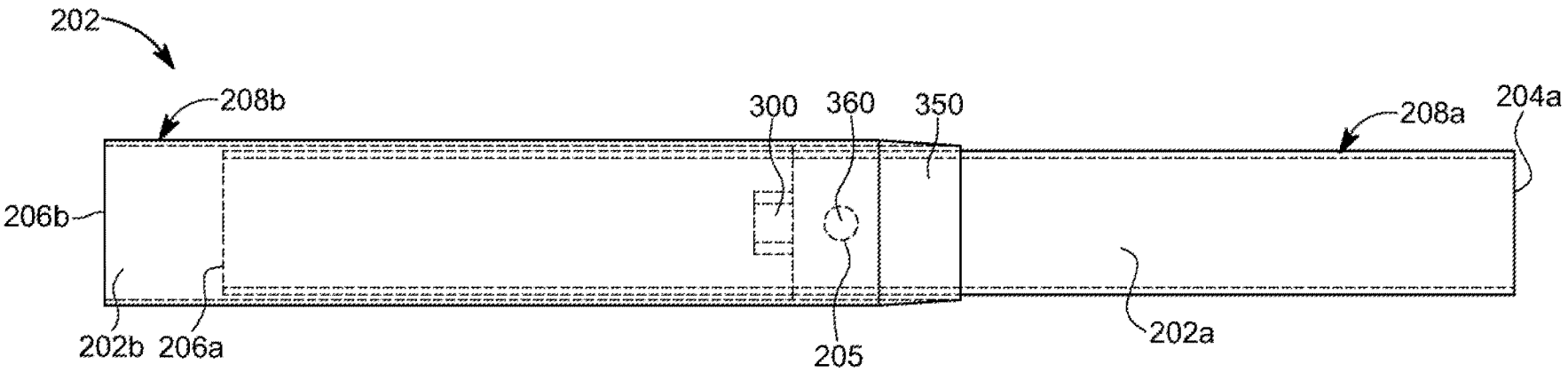
FIG. 23C is a cross-sectional top view of the rod of FIG. 23A.
Figure 23D:
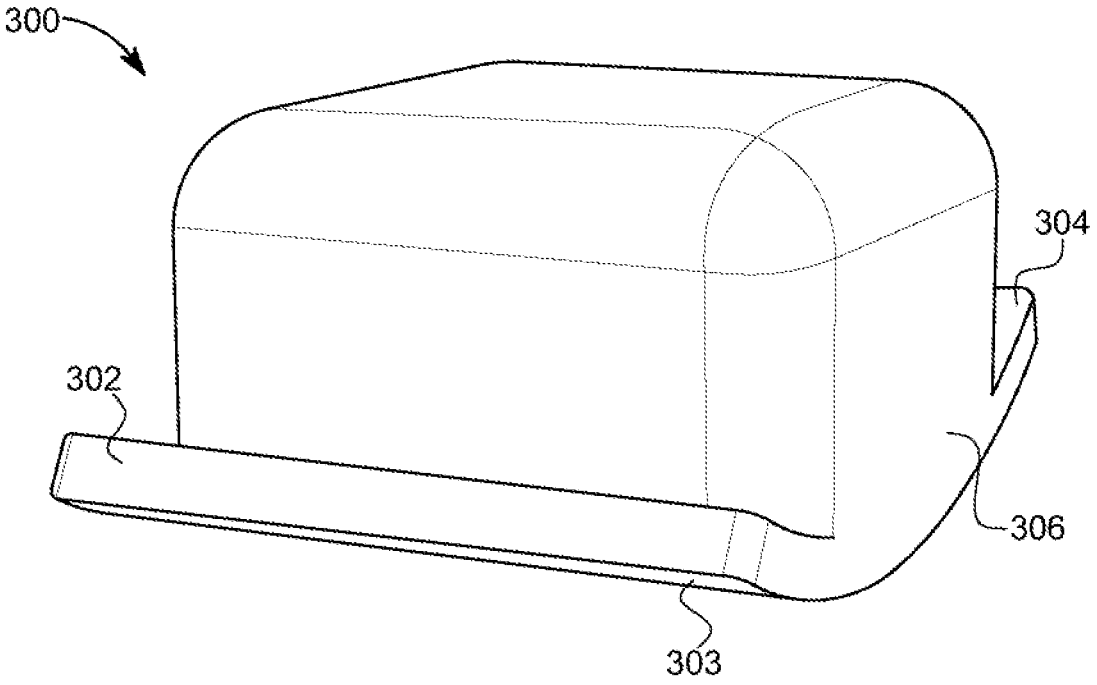
FIG. 23D is a perspective view of an exemplary rod insert.
Figure 23E:
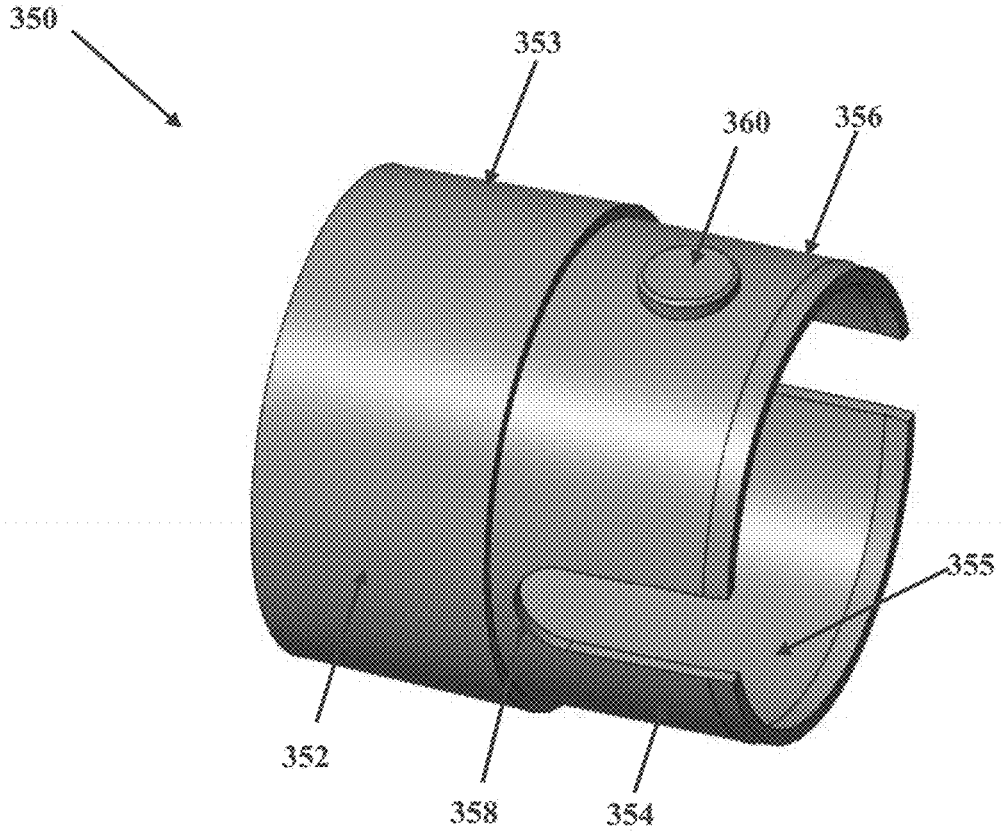
FIG. 23E is a perspective view of an exemplary rod sleeve.
Figure 23F:
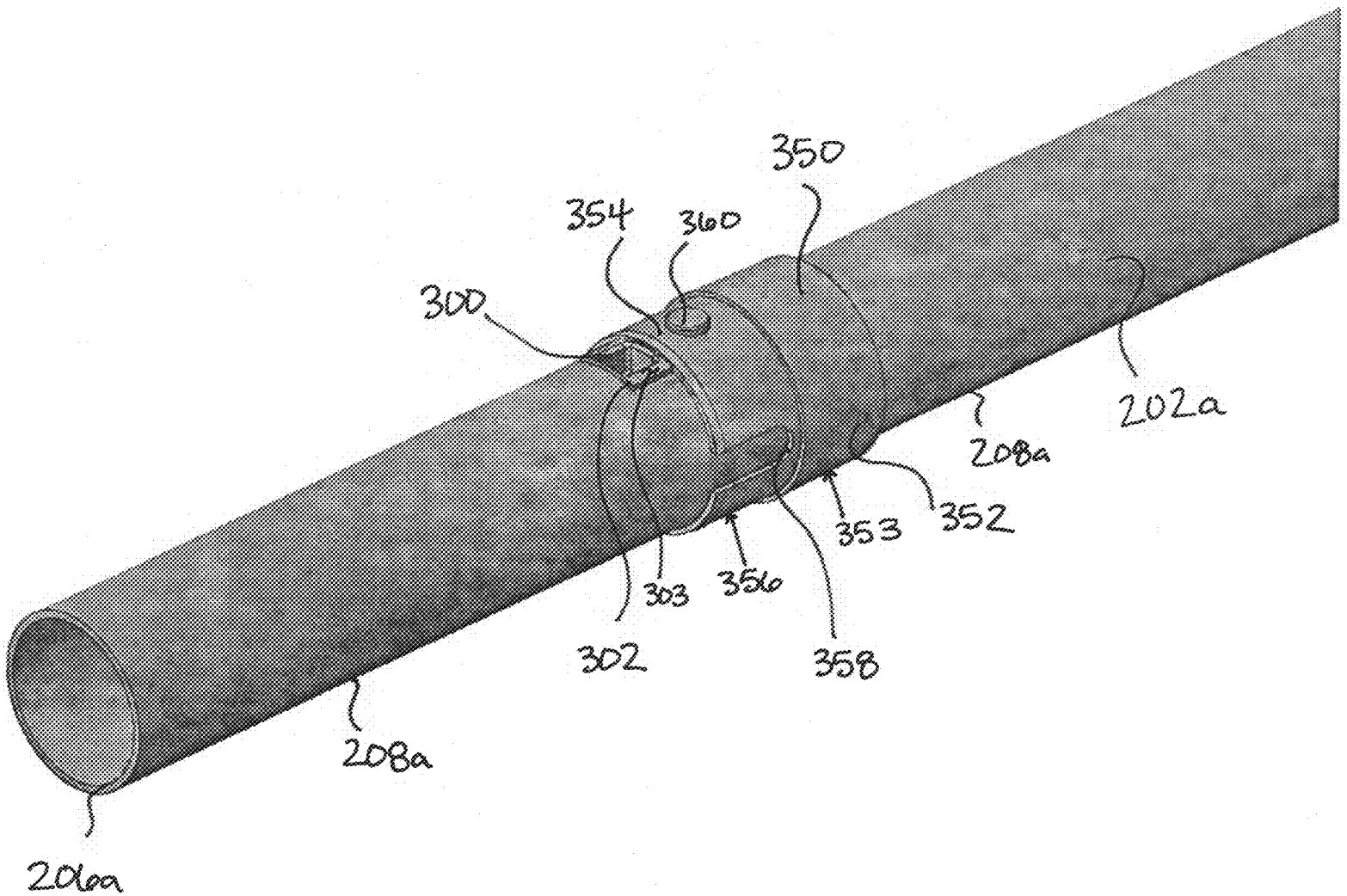
FIG. 23F is a partial perspective view of the rod of FIG. 23A with the second rod portion removed.

In a further embodiment, the storage system 10 may include a wall bracket 90. As shown in FIG. 20, 21A, 21B, 22, the wall bracket 90 has a mount portion 92 which is substantially vertical, a connecting portion 94 extending perpendicularly from a top portion of the mount portion 92, and an arcuate connector 96 extending from the other end of the connecting portion 94. The mount portion 92 may have one or more bracket apertures 98 extending therethrough which may each accommodate a screw, nail, bolt, or other suitable fastener. The arcuate portion 96 has an inside surface with a diameter substantially equivalent to the outer circumferential bar surface 25 of one of the connector bars 18. Similarly to the arcuate portion 234 of the connector 224, the arcuate portion 96 of the wall bracket 90 may also include a pad on the inside surface (not pictured). The arcuate portion 96 may extend from the connecting portion 94 in a similar direction as the mount portion 92 (FIGS. 20, 21A, and 21B) or the arcuate portion 96 may extend from the connecting portion 94 in the opposite direction as the mount portion 92 (FIG. 22). When the arcuate portion 96 extends from the connecting portion 94 in the opposite direction as the mount portion 92, a user may have more space to fasten the wall bracket 90 to a wall or similar surface, as detailed below.

Once the frame system 12 has been constructed and placed in the desired position with the rear of the frame system 12 disposed near a wall or similar surface, the arcuate connector 96 may be disposed on or around one of the connector bars 18 disposed at the rear of the frame system 12. The arcuate connector 96 may be placed around any one of the rear connector bars 18 of the frame system 12. In a preferred embodiment, the arcuate connector 96 is placed around one of the rear connector bars 18 disposed at between the middle and top of the frame system 12. When the arcuate connector 96 is disposed around the connector bar 18 the mount portion 92 may disposed flush against the wall or other similar surface. The wall bracket 90 may be disposed around the connector bar 18 such that the connecting portion 94 is disposed below the connector bar 18 and the mount portion 92 extends upwardly against the wall (FIG. 21A) or such that the connecting portion 94 is disposed above the connector bar 18 and the mount portion 92 extends downwardly against the wall (FIG. 21B). Fasteners may then be inserted through the bracket apertures 98 and into the wall or other surface and thereby secure the wall bracket 90 to the wall or similar surface. When the arcuate connector 96 is secured around one of the connector bars 18 and the mount portion 92 is fastened to the wall, the connection between the wall, wall bracket 90, and connector bar 18 stabilizes the frame system 12 and may prevent the frame system 12 from moving or tipping over. In a further alternative embodiment, when the rod 202 is telescoping, the rod 202 may include a mechanism or system which prevents the first rod portion 202*a* from detaching or otherwise separating from the second rod portion 202*b*. As shown in FIGS. 23A-23F, the rod 202 may include a first rod aperture 203 extending through the first outer circumferential surface 208*a* near the second end 206*a* of the first rod portion 202*a*, a second rod aperture 205 extending through the second outer circumferential surface 208*b* near the first end 204*b* of the second rod portion 202*b*, a rod insert 300 at least partially receivable in the first rod aperture 203, and a rod sleeve 350 at least partially receivable in the second rod aperture 205. In the illustrated embodiment, the first rod aperture 203 is about 4 inches from the second end 206*a* of the first rod portion 202*a*.

The rod insert 300 includes an arcuate insert portion 302 having a first arcuate surface 303 and a second arcuate surface 304 opposite the first arcuate surface 302, and a radial projection 306 extending radially inward from the second arcuate surface 304. The radial projection 306 is sized and shaped to fit within the first rod aperture 203. The second arcuate surface 304 is sized and shaped to fit snugly around the first outer circumferential surface 208*a*, and the first arcuate surface 303 is sized and shaped to fit within an inner diameter of the second rod portion 202*b*.

The rod sleeve 350 includes a generally cylindrical cap portion 352 having a first sleeve outer circumferential surface 353, a generally cylindrical insert portion 354 having a second sleeve outer circumferential surface 356, and a sleeve projection 360 extending radially outward from the insert portion 354. The sleeve projection 360 is sized and shaved to fit within the second rod aperture 205. The cap portion 352 and the insert portion 354 have an inner circumferential sleeve surface 355 which is substantially the same size as the first outer circumferential surface 208*a* of the first rod portion 202*a*. The first sleeve outer circumferential surface 353 may be substantially the same size as the second outer circumferential surface 208*b* and the second sleeve outer circumferential surface 356 may be substantially the same size as an inside surface of the second rod portion 202*b* at the first end 204*b*. In the illustrated embodiment, the insert portion 354 also includes two cutouts 358 which may allow the insert portion 354 to flex or bend and thereby fit into the second rod portion 202*b* more easily.

In use, the radial projection 306 of the rod insert 300 may be inserted into the first rod aperture 203 of the first rod portion 202*a* such that the second arcuate surface 304 is disposed on the first outer circumferential surface 208*a*. The insert portion 354 of the rod sleeve 350 may be inserted into the first end 204*b* of the second rod portion 202*b* until the sleeve projection 360 projects radially outwardly from the second rod aperture 205, thereby securing the rod sleeve 350 in the second rod portion 202*b*. In such a position, the cap portion 352 of the rod sleeve 350 may abut the first end 204*b* of the second rod portion 202*b*. The first rod portion 202*a* may be inserted into the second rod portion 202*b* such that the first rod portion 202*a* fits within the inner circumferential sleeve surface 355 of the rod sleeve 350 and the arcuate insert portion 302 of the rod insert 300 is disposed between the first outer circumferential surface 208*a* of the first rod portion 202*a* and the inner surface of the second rod portion 202*b*. In such an embodiment, the rod insert 300 and the rod sleeve 350 are secured in the rod 202. When the first and second rod portions 202*a*, 202*b* are extended to a maximum allowable distance, the rod insert 300 abuts the rod sleeve 350 and prevents the first and second rod portions 202*a*, 202*b* from being further separated. As such, when the rod insert 300 and the rod sleeve 350 are secured in the rod 202, the first and second rod portions 202*a*, 202*b* may be prevented from telescoping to a distance where they separate.

In the illustrated embodiment, the radial projection 306 and first rod aperture 203 are substantially rectangular and the sleeve projection 360 and second rod aperture 205 are substantially cylindrical. However, the radial projection 306 and sleeve projection 360 may be other shapes and geometries. For example, the radial projection 306 and first rod aperture 203 may be cylindrical and the sleeve projection 360 and second rod aperture 205 may be rectangular, or any of pairs may be triangular, oval, pentagonal, or any other suitable shape or geometry.

Figure 24:
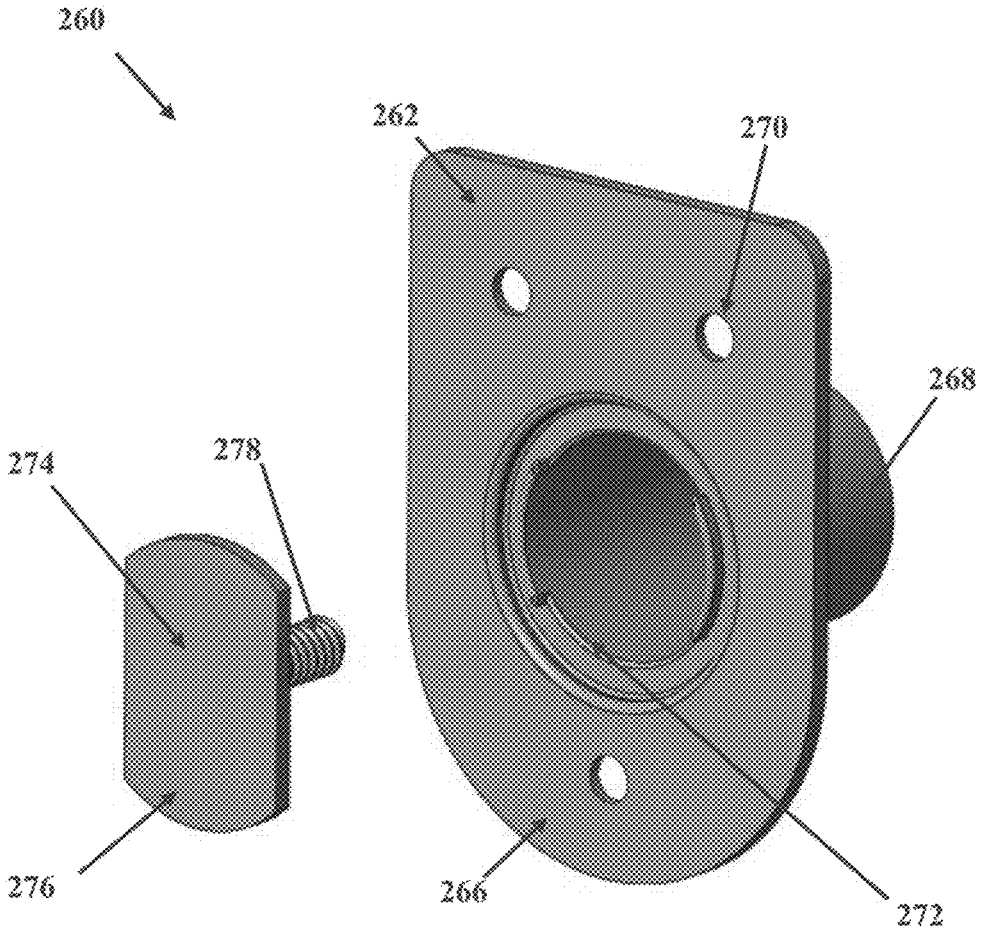
FIG. 24 is an exploded rear perspective view of a mount according to a second embodiment.

Turning to FIG. 24, a mount 260 according to an alternative embodiment is depicted. The mount plate 262 of the mount 260 has a wall aperture 272 in the distal portion surface 266 extending to the rod receiving portion 268. The mount 260 also includes a mount backing 274 having a mount connecting portion 276 and a backing projection 278 extending proximally from the mount connecting portion 276. The backing projection 278 may be received, fastened, threaded, or otherwise secured in a receiving portion in the first end 204 of the rod 202.

In use, before a user secures the mount 260 to the wall or similar surface, the user may insert the first end 204 of the rod 202 through the wall aperture 272 of the mount 272 such that the first end 204 of the rod 202 is distally beyond the distal surface 266 of the mount 260. The user may then secure the backing projection 278 of the mount backing 274 into the receiving portion in the first end 204 of the rod 202. The first end 204 may then be pull proximally back toward the mount 260 and the mount connecting portion 276 may be secured to the mount plate 262 of the mount 262, thereby securing the rod 202, mount 260, and backing projection 278 together. In the illustrated embodiment, the backing projection 278 is threaded and would be received in a receiving portion of the rod 202 which is a threaded bore, and the connecting portion 276 is twist-locked into the mount plate 262. However, the rod 202 and the connecting portion 276 and the connecting portion 276 and the mount plate 262 may be secured by any suitable means. Once the rod 202, the mount 260, and the backing projection 278 are secured together, the user may then secure the mount 260 to the wall.

In exemplary embodiments, a kit is provided with some or all of the components for any of the various exemplary embodiments described above or below and/or shown in the figures. In some exemplary embodiments, the kit includes an instruction sheet showing assembly of the embodiment and the instruction sheet optionally includes instructions showing that the garment hanging rods 202 can be connected to and supported by any of the support rods 40. For example, in exemplary embodiments, the kit instructions show one or more garment hanging rods 202 supported by an upper support rod 40 and extending to the right and/or the left (FIG. 14, e.g., to a respective mount 260). As another example, in exemplary embodiments, the kit instructions show one or more garment hanging rods 202 supported by the upper support rod 40 and extending to the right and/or the left and one or more garment hanging rods 202 supported by a middle support rod 40 and extending to the right and/or the left (FIGS. 18A, 18B, e.g., to a respective mount 260).

As described herein, when one or more components are described as being connected, joined, affixed, coupled, attached, or otherwise interconnected, such interconnection may be direct as between the components or may be indirect such as through the use of one or more intermediary components. Also, as described herein, reference to a "member," "component," or "portion" shall not be limited to a single structural member, component, or element but can include an assembly of components, members or elements.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

Exemplary Embodiments

1. A storage container for use with a storage system, the storage container comprising:

a flexible bottom having a first edge, a second edge, a third edge, and a forth edge;

a first end extending from the first edge of the bottom to a first height substantially the same as a height of a shelf opening of the storage system;

a second end extending from the third edge of the bottom to a second height less than the height of the shelf opening;

a first side wall extending from the second edge of the bottom to a point substantially equivalent to the first height near the first end and the second height near the second end;

a second side wall extending from the fourth edge of the bottom to a point substantially equivalent to the first height near the first end and the second height near the second end; and a rigid insert receivable between the first and second ends and first and second side walls;

wherein the first and second side walls are inwardly collapsible when the rigid insert is removed from the storage container; and wherein the storage container may be inserted into the shelf opening with either the first or second end facing outward from the storage system.

2. The storage container of the above embodiment, further comprising one or more handles disposed on an exterior face either the first end wall or second end wall.

3. The storage container of any of the above embodiments, further comprising at least one liner disposed in an interior space of the storage container along one or more of the first end wall, the second end wall, the first side wall, and the second side wall.

4. The storage container of any of the above embodiments, wherein each liner further comprises an elastic band at an upper portion of the liner which biases the liner toward one of the first end wall, the second end wall, the first side wall, and the second side wall.

5. The storage container of any of the above embodiments, wherein the first side wall and the second side wall each have a top edge which curves between the first height near the first end wall and the second height near the second end wall.

6. The storage container of any of the above embodiments, wherein the first end wall and the second end wall are rectangular.

7. The storage container of any of the above embodiments, wherein the storage container comprises a fabric.

8. The storage container of any of the above embodiments, wherein an interior space of the container is viewable when the second end wall defines a front of the shelf opening.

9. A rod attachment system for use with a storage system, the rod attachment system comprising:

a rod having a first end and a second end, the second end having a receiving portion a fastener having a cap portion with a first diameter and a projection portion with a second diameter, the first diameter being larger than the second diameter; and a connector having a planar portion and an arcuate portion, the planar portion having a first side, a second side opposite the first side, and an aperture extending from the first side to the second side and having a third diameter;

wherein the third diameter is larger than the second diameter and smaller than the first diameter; and wherein the rod attachment system is securable to the storage system by disposing the arcuate portion over a support rod of the storage system, inserting the projection portion of the connector through the aperture from the first side to the second side, and securing the projection portion of the connector in the receiving portion of the rod.

10. The rod attachment system of the above embodiments, further comprising a pad disposed on the inside surface of the arcuate portion.

11. The rod attachment system of any of embodiments 9 through 10, wherein the projection portion of the fastener is threadingly securable in the receiving portion of the rod.

12. The rod attachment system of any of embodiments 9 through 11, wherein one end of the arcuate portion terminates in a flange extending radially outward.

13. The rod attachment system of any of embodiments 9 through 12, wherein the rod is telescoping.

14. The rod attachment system of any of embodiments 9 through 13, further comprising a mount having a rod receiving portion and being securable on a wall or similar surface.

15. The rod attachment system of any of embodiments 9 through 14, wherein the arcuate portion has an inside surface having a diameter substantially the same size as a diameter of an outer circumferential rod surface of a support rod of the storage system.

16. The rod attachment system of any of embodiments 9 through 15, wherein the cap portion of the fastener is larger than the aperture of the connector.

17. A storage system, the storage system comprising:

a frame system comprising:

a first side frame comprising a first leg, a second leg, a support rod connecting the first leg and second leg, and at least one shelving track extending horizontally between the first and second legs;

a second side frame comprising a third leg, a fourth leg, a support rod connecting the third and fourth legs, and at least one shelving track extending horizontally between the third and fourth legs; and at least one connector bar connecting the first side frame and the second side frame;

a rod attachment system comprising;

a rod having a first end, a second end, and a receiving portion in the second end;

a connector having an arcuate portion, a planar portion, and an aperture through the planar portion; and a fastener having a cap portion and a projection portion, the projection portion being securable within the receiving portion of the rod; and a mount having a rod receiving portion and being securable to a wall.

18. The storage system of the above embodiment, wherein the rod attachment system may be attached to the support rod of the first frame side or the support rod of the second frame side.

19. The storage system of any of embodiments 17 or 18, further comprising at least one of a storage container and a shelf disposed one of the at least one shelving tracks of the first side and one of the at least one shelving tracks of the second side.

20. The storage system of any of embodiments 17 through 19, wherein the projection portion of the fastener is inserted through the aperture of the planar portion and securable in the receiving portion of the rod.

21. The storage system of any of embodiments 17 through 19 further comprising a storage container according to any of the foregoing embodiments.

22. The storage system of any of embodiments 17 through 19 further comprising a rod attachment system according to any of the foregoing embodiments.

23. The storage system of any of embodiments 17 through 19 further comprising a rod attachment system according to any of the foregoing embodiments and a storage container according to any of the foregoing embodiments.

24. A kit, comprising: frame components and an instruction sheet teaching one or more upper garment hanging rods supported by a respective upper support rod of the frame and extending to the right and/or the left and also one or more lower garment hanging rods supported by a middle support rod of a frame and extending to the right and/or the left.

25. A kit, comprising: a storage container or rod attachment system or storage system according to any of the foregoing embodiments comprising an instruction sheet teaching one or more upper garment hanging rods supported by a respective upper support rod of a frame and extending to the right and/or the left and also one or more lower garment hanging rods supported by a middle support rod of a frame and extending to the right and/or the left.

What is claimed is:

1. A rod attachment system for use with a storage system, the rod attachment system comprising:

a rod having a first end and a second end, the second end having a receiving portion a fastener having a cap portion with a first diameter and a projection portion with a second diameter, the first diameter being larger than the second diameter; and a connector having a planar portion and an arcuate portion, the planar portion having a first side, a second side opposite the first side, and an aperture extending from the first side to the second side and having a third diameter;

wherein the third diameter is larger than the second diameter and smaller than the first diameter;

wherein the rod attachment system is securable to the storage system by disposing the arcuate portion of the connector over a support rod of the storage system, inserting the projection portion of the fastener through the aperture of the connector from the first side to the second side, and securing the projection portion of the fastener in the receiving portion of the rod on the second side of the connector;

wherein the planar and arcuate portions of the connector are continuous;

wherein the planar portion of the connector hangs substantially vertically when the arcuate portion of the connector is disposed over the support rod;

wherein the planar portion of the connector, the fastener, and the rod are disposed below the support rod when the rod attachment system is secured to the storage system; and wherein the arcuate portion of the connector is configured to substantially cover an outer circumferential surface of the support rod.

2. The rod attachment system of claim 1, further comprising a pad disposed on an inside surface of the arcuate portion.

3. The rod attachment system of claim 1, wherein the projection portion of the fastener is threadingly securable in the receiving portion of the rod.

4. The rod attachment system of claim 1, wherein one end of the arcuate portion terminates in a flange extending radially outward.

5. The rod attachment system of claim 1, wherein the rod is telescoping.

6. The rod attachment system of claim 1, further comprising a mount having a rod receiving portion and being securable on a wall or similar surface.

7. The rod attachment system of claim 1, wherein the arcuate portion has an inside surface having a diameter substantially the same size as a diameter of an outer circumferential rod surface of a support rod of the storage system.

8. The rod attachment system of claim 1, wherein the cap portion of the fastener is larger than the aperture of the connector.

9. A storage system, the storage system comprising:

a frame system comprising:

a first side frame comprising a first leg, a second leg, a support rod connecting the first leg and second leg, and at least one shelving track extending horizontally between the first and second legs;

a second side frame comprising a third leg, a fourth leg, a support rod connecting the third and fourth legs, and at least one shelving track extending horizontally between the third and fourth legs; and at least one connector bar connecting the first side frame and the second side frame;

a rod attachment system comprising;

a rod having a first end, a second end, and a receiving portion in the second end;

a connector having an arcuate portion, a planar portion, and an aperture through the planar portion; and a fastener having a cap portion and a projection portion, the projection portion being securable within the receiving portion of the rod; and a mount having a rod receiving portion and being securable to a wall;

wherein the planar and arcuate portions of the connector are continuous;

wherein the rod attachment is securable to the storage system and mount by disposing the arcuate portion of the connector over a support rod of the storage system, inserting the projection portion of the fastener through the aperture of the connector from the first side to the second side, securing the projection portion of the fastener in the receiving portion of the rod on the second side of the connector, and disposing the second end of the rod in the rod receiving portion of the mount;

wherein the planar portion of the connector hangs substantially vertically when the arcuate portion of the connector is disposed over the support rod;

wherein the rod is gravitationally secured between the mount and the frame when the rod attachment system is secured to the storage system and mount.

10. The storage system of claim 9, wherein the rod attachment system may be attached to the support rod of the first frame side or the support rod of the second frame side.

11. The storage system of claim 9, further comprising at least one of a storage container and a shelf disposed one of the at least one shelving tracks of the first side and one of the at least one shelving tracks of the second side.

12. The storage system of claim 9, wherein the projection portion of the fastener is inserted through the aperture of the planar portion and securable in the receiving portion of the rod.

13. A storage system, the storage system comprising:

(a) a frame system comprising:

a first side frame comprising a first leg, a second leg, a first support rod connecting the first leg and second leg and extending horizontally between the first and second legs, and a first plurality of shelving tracks extending horizontally between the first and second legs;

a second side frame comprising a third leg, a fourth leg, a second support rod connecting the third and fourth legs and extending horizontally between the third and fourth legs, and a second plurality of shelving tracks extending horizontally between the third and fourth legs; and at least one connector bar connecting the first side frame and the second side frame at locations proximate respective first and second support rods;

(b) a storage container sized and configured to be carried by, and span between, a shelving track of the first plurality of shelving tracks and a corresponding shelving track of the second plurality of shelving tracks, the storage container comprising:

a flexible bottom having a first edge, a second edge, a third edge, and a fourth edge;

a first end having a first handle and extending from the first edge of the bottom to a first height substantially the same as a height of a shelf opening of the storage system formed by the vertical spacing of the first and second pluralities of shelving tracks;

a second end having a second handle extending from the third edge of the bottom to a second height less than the first height;

a first side wall extending from the second edge of the bottom to a point substantially equivalent to the first height near the first end and the second height near the second end;

a second side wall extending from the fourth edge of the bottom to a point substantially equivalent to the first height near the first end and the second height near the second end; and a rigid insert receivable between the first and second ends and first and second side walls;

(c) a rod attachment system comprising;

a rod for hanging garments, the rod having a first end, a second end, and a receiving portion in the second end;

a connector having an arcuate portion, a planar portion, and an aperture through the planar portion, the arcuate portion sized and configured to connect to one of the first and second support rods connecting the first leg and second leg; and a fastener having a cap portion and a projection portion, the projection portion being securable within the receiving portion of the rod; and (d) a mount having a rod receiving portion and being securable to a wall.

* * * * *